US006965353B2

(12) United States Patent
Shirosaka et al.

(10) Patent No.: US 6,965,353 B2
(45) Date of Patent: Nov. 15, 2005

(54) MULTIPLE FREQUENCY BAND ANTENNA AND SIGNAL RECEIVING SYSTEM USING SUCH ANTENNA

(75) Inventors: Toshiaki Shirosaka, Kobe (JP); Toshio Fujita, Kobe (JP); Kiyotaka Tatekawa, Kobe (JP); Shingo Fujisawa, Kobe (JP); Eiji Shibuya, Kobe (JP)

(73) Assignee: DX Antenna Company, Limited, Hyogo-ken (JP)

( * ) Notice: Subject to any disclaimer, the term of this patent is extended or adjusted under 35 U.S.C. 154(b) by 16 days.

(21) Appl. No.: 10/822,338

(22) Filed: Apr. 12, 2004

(65) Prior Publication Data

US 2005/0062667 A1 Mar. 24, 2005

(30) Foreign Application Priority Data

Sep. 18, 2003 (JP) ..... 2003-326148
Feb. 25, 2004 (JP) ..... 2004-049087

(51) Int. Cl.[7] ..... H01Q 9/16
(52) U.S. Cl. ..... 343/802; 343/801; 343/795
(58) Field of Search ..... 343/794, 795, 343/793, 801, 802, 810, 812, 813, 814, 816; H01Q 9/16

(56) References Cited

U.S. PATENT DOCUMENTS 2,967,300 A * 1/1961 Haughawout ..... 343/750
6,417,807 B1 * 7/2002 Hsu et al. ..... 343/700 MS
2005/0116869 A1 * 6/2005 Siegler et al. ..... 343/749

OTHER PUBLICATIONS

"Antenna Engineering Handbook," Edited by The Institute of Electronics Information and Communication Engineers of Japan; published by Ohm-Sha, Jan. 25, 2001.

* cited by examiner

*Primary Examiner*—Hoanganh Le
(74) *Attorney, Agent, or Firm*—Duane Morris LLP

(57) ABSTRACT

A multiple frequency band antenna includes a dipole antenna (4*a*), which is formed of two dipole antenna elements (8*a*, 10*a*). Two extension elements (24*a*, 26*a*) extend outward from respective ones of opposed outer ends of the dipole antenna (4*a*). The length of the dipole antenna (4*a*) is determined to make the multiple frequency band antenna capable of receiving radio waves in the UHF band, and the sum of the lengths of the dipole antenna (4*a*) and the extension elements (24*a*, 26*a*) is determined to make the multiple frequency band antenna capable of receiving radio waves in the VHF band. PIN diodes (28*a*, 34*a*) are connected between the respective extension elements (24*a*, 26*a*) and the respective outer ends of the dipole antenna (4*a*). When a radio wave in the UHF band is to be received, a control unit (180) places the diodes (28*a*, 34*a*) selectively in a state in which both are opened, a state in which one of the diodes (28*a*) is closed while the other (34*a*) is opened, and a state in which the one diode (28*a*) is opened while the other (34*a*) is closed.

12 Claims, 12 Drawing Sheets

| Angle | Code | Switch Devices | | | | Variable Attenuators | | | | | |
|---|---|---|---|---|---|---|---|---|---|---|---|
| | | | | | | 0dB | 7dB | ∞dB | 0dB | 7dB | ∞dB |
| | | a | A | b | B | C | D | E | F | G | H |
| 0 | 0000 | 1 | 0 | 0 | 1 | 1 | 0 | 0 | 0 | 0 | 1 |
| 22.5 | 0001 | 1 | 0 | 0 | 1 | 1 | 0 | 0 | 0 | 1 | 0 |
| 45 | 0010 | 1 | 0 | 0 | 1 | 1 | 0 | 0 | 1 | 0 | 0 |
| 67.5 | 0011 | 1 | 0 | 0 | 1 | 0 | 1 | 0 | 1 | 0 | 0 |
| 90 | 0100 | 0 | 1 | 0 | 1 | 0 | 0 | 1 | 1 | 0 | 0 |
| 112.5 | 0101 | 0 | 1 | 0 | 1 | 0 | 1 | 0 | 1 | 0 | 0 |
| 135 | 0110 | 0 | 1 | 0 | 1 | 1 | 0 | 0 | 1 | 0 | 0 |
| 157.5 | 0111 | 0 | 1 | 0 | 1 | 1 | 0 | 0 | 0 | 1 | 0 |
| 180 | 1000 | 0 | 1 | 1 | 0 | 1 | 0 | 0 | 0 | 0 | 1 |
| 202.5 | 1001 | 0 | 1 | 1 | 0 | 1 | 0 | 0 | 0 | 1 | 0 |
| 225 | 1010 | 0 | 1 | 1 | 0 | 1 | 0 | 0 | 1 | 0 | 0 |
| 247.5 | 1011 | 0 | 1 | 1 | 0 | 0 | 1 | 0 | 1 | 0 | 0 |
| 270 | 1100 | 1 | 0 | 1 | 0 | 0 | 0 | 1 | 1 | 0 | 0 |
| 292.5 | 1101 | 1 | 0 | 1 | 0 | 0 | 1 | 0 | 1 | 0 | 0 |
| 315 | 1110 | 1 | 0 | 1 | 0 | 1 | 0 | 0 | 1 | 0 | 0 |
| 337.5 | 1111 | 1 | 0 | 1 | 0 | 1 | 0 | 0 | 0 | 1 | 0 |

FIG. 4

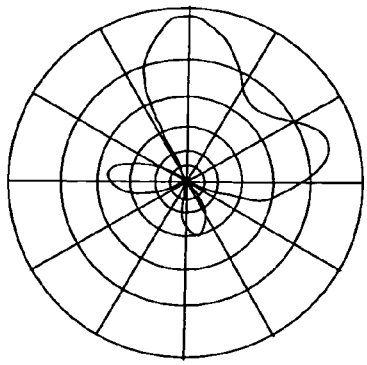
FIG. 5
FIG. 6A
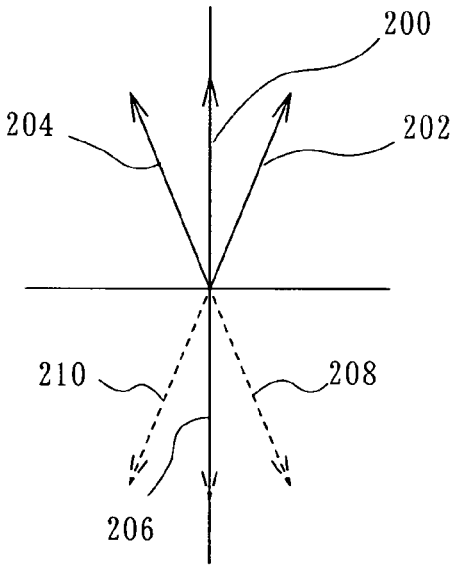
FIG. 6B
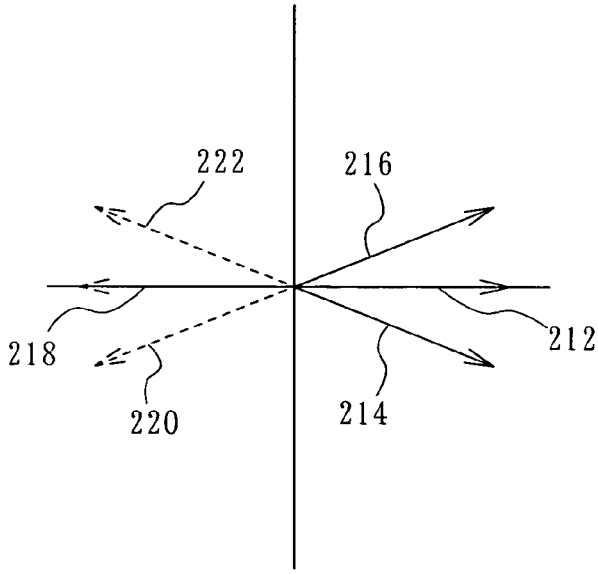
FIG. 6C
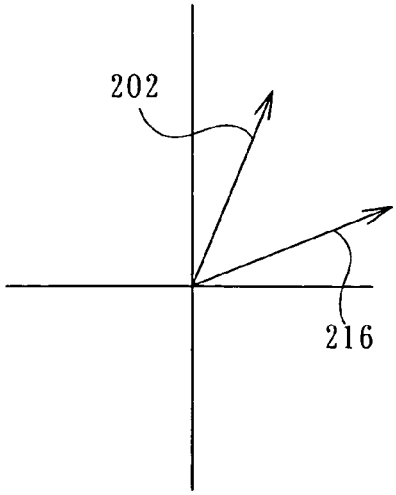

0°

22.5°

45°

62.5°

90°

| Angle | Code | Switch Devices | | | | Variable Attenuator | | | | | | 1st Antenna | | 2nd Antenna | |
|---|---|---|---|---|---|---|---|---|---|---|---|---|---|---|---|
| | | | | | | 0dB | 7dB | ∞dB | 0dB | 7dB | ∞dB | Left | Right | Left | Right |
| | | a | A | b | B | C | D | E | F | G | H | I | J | K | L |
| 0 | 0000 | 1 | 0 | 0 | 1 | 1 | 0 | 0 | 0 | 0 | 1 | 0 | 0 | 0 | 0 |
| 22.5 | 0001 | 1 | 0 | 0 | 1 | 1 | 0 | 0 | 0 | 1 | 0 | 0 | 1 | 1 | 0 |
| 45 | 0010 | 1 | 0 | 0 | 1 | 1 | 0 | 0 | 1 | 0 | 0 | 0 | 1 | 1 | 0 |
| 67.5 | 0011 | 1 | 0 | 0 | 1 | 0 | 1 | 0 | 1 | 0 | 0 | 0 | 1 | 1 | 0 |
| 90 | 0100 | 0 | 1 | 0 | 1 | 0 | 0 | 1 | 1 | 0 | 0 | 0 | 0 | 0 | 0 |
| 112.5 | 0101 | 0 | 1 | 0 | 1 | 0 | 1 | 0 | 1 | 0 | 0 | 0 | 1 | 0 | 1 |
| 135 | 0110 | 0 | 1 | 0 | 1 | 1 | 0 | 0 | 1 | 0 | 0 | 0 | 1 | 0 | 1 |
| 157.5 | 0111 | 0 | 1 | 0 | 1 | 1 | 0 | 0 | 0 | 1 | 0 | 0 | 1 | 0 | 1 |
| 180 | 1000 | 0 | 1 | 1 | 0 | 1 | 0 | 0 | 0 | 0 | 1 | 0 | 0 | 0 | 0 |
| 202.5 | 1001 | 0 | 1 | 1 | 0 | 1 | 0 | 0 | 0 | 1 | 0 | 1 | 0 | 0 | 1 |
| 225 | 1010 | 0 | 1 | 1 | 0 | 1 | 0 | 0 | 1 | 0 | 0 | 1 | 0 | 0 | 1 |
| 247.5 | 1011 | 0 | 1 | 1 | 0 | 0 | 1 | 0 | 1 | 0 | 0 | 1 | 0 | 0 | 1 |
| 270 | 1100 | 1 | 0 | 1 | 0 | 0 | 0 | 1 | 1 | 0 | 0 | 0 | 0 | 0 | 0 |
| 292.5 | 1101 | 1 | 0 | 1 | 0 | 0 | 1 | 0 | 1 | 0 | 0 | 1 | 0 | 1 | 0 |
| 315 | 1110 | 1 | 0 | 1 | 0 | 1 | 0 | 0 | 1 | 0 | 0 | 1 | 0 | 1 | 0 |
| 337.5 | 1111 | 1 | 0 | 1 | 0 | 1 | 0 | 0 | 0 | 1 | 0 | 1 | 0 | 1 | 0 |

FIG. 8

| Angle | Code | Switch Devices | | | | Variable Attenuator | | | | | | 1st Antenna | | 2nd Antenna | |
|---|---|---|---|---|---|---|---|---|---|---|---|---|---|---|---|
| | | | | | | 0dB | 7dB | ∞dB | 0dB | 7dB | ∞dB | Left | Right | Left | Right |
| | | A | a | B | b | C | D | E | F | G | H | I | J | K | L |
| 0 | 0000 | 1 | 0 | 0 | 1 | 1 | 0 | 0 | 0 | 0 | 1 | 0 | 0 | 0 | 0 |
| 22.5 | 0001 | 1 | 0 | 0 | 1 | 1 | 0 | 0 | 0 | 1 | 0 | 0 | 1 | 1 | 0 |
| 45 | 0010 | 1 | 0 | 0 | 1 | 1 | 0 | 0 | 1 | 0 | 0 | 0 | 1 | 1 | 0 |
| 67.5 | 0011 | 1 | 0 | 0 | 1 | 0 | 1 | 0 | 1 | 0 | 0 | 0 | 1 | 1 | 0 |
| 90 | 0100 | 0 | 1 | 0 | 1 | 0 | 0 | 1 | 1 | 0 | 0 | 0 | 0 | 0 | 0 |
| 112.5 | 0101 | 0 | 1 | 0 | 1 | 0 | 1 | 0 | 1 | 0 | 0 | 0 | 1 | 0 | 1 |
| 135 | 0110 | 0 | 1 | 0 | 1 | 1 | 0 | 0 | 1 | 0 | 0 | 0 | 1 | 0 | 1 |
| 157.5 | 0111 | 0 | 1 | 0 | 1 | 1 | 0 | 0 | 0 | 1 | 0 | 0 | 1 | 0 | 1 |
| 180 | 1000 | 0 | 1 | 0 | 1 | 1 | 0 | 0 | 0 | 0 | 1 | 0 | 0 | 0 | 0 |
| 202.5 | 1001 | 0 | 1 | 1 | 0 | 1 | 0 | 0 | 0 | 1 | 0 | 1 | 0 | 0 | 1 |
| 225 | 1010 | 0 | 1 | 1 | 0 | 1 | 0 | 0 | 1 | 0 | 0 | 1 | 0 | 0 | 1 |
| 247.5 | 1011 | 0 | 1 | 1 | 0 | 0 | 1 | 0 | 1 | 0 | 0 | 1 | 0 | 0 | 1 |
| 270 | 1100 | 1 | 0 | 1 | 0 | 0 | 0 | 1 | 1 | 0 | 0 | 0 | 0 | 0 | 0 |
| 292.5 | 1101 | 1 | 0 | 1 | 0 | 0 | 1 | 0 | 1 | 0 | 0 | 1 | 0 | 1 | 0 |
| 315 | 1110 | 1 | 0 | 1 | 0 | 1 | 0 | 0 | 1 | 0 | 0 | 1 | 0 | 1 | 0 |
| 337.5 | 1111 | 1 | 0 | 1 | 0 | 1 | 0 | 0 | 0 | 1 | 0 | 1 | 0 | 1 | 0 |

FIG. 11

506
508
Antenna System
500
500a
500b
510
534a
534b
534d
538
ASK Modulator
BPF
512
534
514
534c
Spliter
516
518a
518b
Satellite Receiver
521
Tuner
Demodulator
520
522
532
Memory
524
C/N Ratio Detector
DATA
CPU
Bit Error Rate Detector
526
Level Detector
530
528
DC12V
DC Power Supply
536
518

MULTIPLE FREQUENCY BAND ANTENNA AND SIGNAL RECEIVING SYSTEM USING SUCH ANTENNA

This invention relates to a multiple frequency band antenna capable of receiving radio waves in a plurality of frequency bands, and, more particularly, to such an antenna having a directivity which is variable in at least one frequency band.

BACKGROUND OF THE INVENTION

A variable directivity antenna is known, which has its directivity variable to a direction from which a desired radio wave comes. An example of such variable directivity antennas is a dipole antenna with an asymmetrically loaded feed point disclosed in Page 43 of a book "Antenna Engineering Handbook", First Edition, Eleventh Print, published on Jan. 25, 2001 from The Institute of Electronics, Information and Communication Engineers of Japan.

According to the technique disclosed in this book, a location to be basically fed of a 1.5 wavelength or 2 wavelength multiple-feed point dipole antenna, which is to be fed at a plurality of locations and, therefore, tends to need a relatively complicated feeding system, is loaded with an impedance, and counterelectromotive force is used for controlling current distribution on the dipole antenna. This handbook states that by electrically controlling the load impedance, the dipole antenna can be a variable directivity antenna.

The dipole antenna according to the handbook can receive radio waves only in a single frequency band, but it cannot be used to receive radio waves in a plurality of frequency bands. Furthermore, electrical control of the load impedance is troublesome.

An object of the present invention is to provide a multiple frequency band antenna which has its directivity easily varied at least in one frequency band, and which is capable of receiving radio waves in a plurality of frequency bands.

SUMMARY OF THE INVENTION

A multiple frequency band antenna according to an embodiment of the present invention has a dipole antenna, which is arranged on a straight line and may include two straight dipole antenna elements. At least two extension elements extend outward from opposite outer ends of the dipole antenna along the straight line. At least one extension element is disposed at one outer end of the dipole antenna, and at least one extension element is disposed at the other outer end of the dipole antenna. Two or more extension elements may be disposed at each of the one and other outer ends of the dipole antenna. The length of the dipole antenna is so determined as to make the antenna capable of receiving radio waves in a first frequency band, and the sum of the length of the dipole antenna and the extension elements at the respective two outer ends of the dipole antenna is so determined as to make the antenna capable of receiving radio waves in a second frequency band, which is lower than the first frequency band. First and second switch devices are disposed between the at least two extension elements and the outer ends of the dipole antenna, respectively. Control means controls the first and second switch devices to selectively provide a first state in which the first and second switch devices are opened, a second state in which the first switch device is closed and the second switch device is opened, and a third state in which the first switch device is opened and the second switch device is closed, when the antenna is to receive a radio wave in the first frequency band.

A reactance element may be connected in parallel with each of the first and second switch devices. The values of the reactance elements are so selected that the dipole antenna is substantially disconnected from the extension elements in the first frequency band, and that the dipole antenna is substantially connected to the respective extension elements in the second frequency band. Furthermore, the values of the reactance elements, when the sum of the dipole antenna elements and the extension elements is shorter than the length required for receiving radio waves in the second frequency band, may be determined such that the reactance elements can provide loading effect that can make it possible to receive well radio waves in the second frequency band. The control means causes the first and second switch devices to be opened when a radio wave in the second frequency band is received.

The dipole antenna may be formed of two straight dipole antenna elements. Each of the two straight dipole antenna elements may be formed of two parallel, spaced-apart conductors, which are coupled to each other in terms of high frequency. They may be coupled with each other by a capacitor, for example. Each of the first and second switch devices includes a PIN diode connected between the outer end of one of the two conductors of the associated dipole antenna element and the extension element disposed outward of the outer end of that conductor, and a DC current path connected between the outer end of the other conductor and the extension element outward of that outer end.

According to another embodiment of the present invention, a multiple frequency band antenna includes first and second dipole antennas for receiving radio waves in a first frequency band. The first and second dipole antennas are disposed in parallel with each other and spaced by a distance equal to or shorter than a quarter (¼) of a wavelength in the first frequency band. At least one first extension elements extend outward from each of the opposite outer ends of the first dipole antenna along a first straight line. At least one second extension elements extend outward from each of the opposite outer ends of the second dipole antenna along a second straight line. The sum of the length of the first dipole antenna and the lengths of the first extension elements and the sum of the length of the second dipole antenna and the lengths of the second extension elements are so determined that the multiple frequency band antenna can receive radio waves in a second frequency band which is lower than the first frequency band. First and second switch devices are connected between the two outer ends of the first dipole antenna and the respective ones of the first extension elements. Third and fourth switch devices are connected between the two outer ends of the second dipole antenna and the respective ones of the second extension elements. The third and fourth switch devices are disposed at locations corresponding to the first and second switch devices, respectively. When a radio wave in the first frequency band is received, control means controls the first through fourth switch devices to selectively place them in a first state in which the first through fourth switch devices are opened, a second state in which the first and third switch devices are closed and the second and fourth switch devices are opened, and a third state in which the first and third switch devices are opened and the second and fourth switch devices are closed.

Combining means is connected to the first and second dipole antennas. Phase shifting means are connected between respective ones of the first and second dipole antennas and the combining means. The phase shifting means are arranged to be switchable between a first signal coupling state and a second signal coupling state. In the first signal coupling state, the phase shifting means cause a signal from a first direction substantially perpendicular to the first and second dipole antennas as received at the first and second dipole antennas to be coupled to the combining means substantially in phase with each other, and cause a signal from a second direction opposite to the first direction as received at the first and second dipole antennas to be coupled to the combining means substantially 180° out of phase with each other. In the second signal coupling state, the phase shifting means cause a signal from the first direction as received at the first and second dipole antennas to be coupled to the combining means substantially 180° out of phase with each other, and cause a signal from the second direction as received at the first and second dipole antennas to be coupled to the combining means substantially in phase with each other.

The phase shifting means include first fixed phase shift means connected between the first dipole antenna and the combining means, switch means connected in parallel with the first fixed phase shift means, and second fixed phase shift means connected between the second dipole antenna and the combining means. The amount of phase shift provided by the first fixed phase shift means is twice the phase shift provided by the second fixed phase shift means.

According to still other embodiment of the present invention, a multiple frequency band antenna includes an antenna group including first and second orthogonally disposed antennas. Each of the first and second antennas includes first and second dipole antennas disposed in parallel with each other with a spacing equal to or shorter than a quarter (¼) of a wavelength in a first frequency band. A group of extension elements are also provided. The extension element group include a first extension elements extending outward from each of the opposite outer ends of the first dipole antenna along a straight line, and a second extension elements extending outward from each of the opposite outer ends of the second dipole antenna along a straight line. The sum in length of the first dipole antenna and the first extension elements and the sum in length of the second dipole antenna and the second extension elements are determined such that the antenna can receive radio waves in a second frequency band, which is lower than the first frequency band. Also, a group of switch devices are used. The switch device group include first and second switch devices connected between the respective outer ends of the first dipole antenna and the associated first extension elements, and third and fourth switch devices connected between the respective outer ends of the second dipole antenna and the associated second extension elements. The third and fourth switch devices are disposed at locations corresponding to the first and second switch devices, respectively.

First combining means is connected to the first and second dipole antennas. Phase shifting means are connected between the respective ones of the first and second dipole antennas and the combining means. The phase shifting means are arranged to be switchable between a first signal coupling state and a second signal coupling state. In the first signal coupling state, the phase shifting means cause a signal from a first direction substantially perpendicular to the first and second dipole antennas as received at the first and second dipole antennas to be coupled to the combining means substantially in phase with each other, and cause a signal from a second direction opposite to the first direction as received at the first and second dipole antennas to be coupled to the combining means substantially 180° out of phase with each other. In the second signal coupling state, the phase shifting means cause a signal from the first direction as received at the first and second dipole antennas to be coupled to the combining means substantially 180° out of phase with each other, and cause a signal from the second direction as received at the first and second dipole antennas to be coupled to the combining means substantially in phase with each other.

First and second level adjusting means adjust the levels of the signals from the first and second antennas, respectively. Outputs from the first and second level adjusting means are combined by second combining means. Control means controls the first through fourth switch devices of the first and second antennas, the phase shifting means of the first and second antennas, and the first and second level adjusting means, in such a manner that a radio wave in the first or second frequency band from a desired direction can be received. Additional phase shifting means may be connected between respective ones of the first and second level adjusting means and the second combining means.

The control means may be so configured as to control the first through fourth switch devices of the first and second antennas, the phase shifting means of the first and second antennas, and the first and second level adjusting means, in accordance with a control signal produced by demodulating a modulation signal supplied thereto from modulating means through a transmission path. In this case, a signal from the second combining means is coupled to a receiving apparatus through the transmission path. The modulating means modulates a carrier with a control signal supplied from the receiving apparatus to produce the modulation signal.

The modulating means may ASK (amplitude-shift-keying) modulate the carrier.

The receiving apparatus may include receiving state detecting means, which detects how a desired signal is being received. The receiving apparatus is provided with receiving apparatus control means, which, when the receiving state changes to an unacceptable one, operates to change the control signal to be supplied to the modulating means and supplies the modulating means with the control signal available when the receiving state as detected by the receiving state detecting means.

A signal from another antenna may be supplied to the antenna group. In such a case, the antenna group is provided with combining means for combining the signal available from another antenna and the signal available from the antenna group. An output signal from the combining means is supplied through the transmission path to the receiving apparatus.

BRIEF DESCRIPTION OF THE DRAWINGS

FIG. 4 shows controlled states of various portions of the antenna of FIG. 1.

FIG. 5 is a directivity pattern for the UHF band of the antenna of FIG. 1 with all switch devices opened.

FIGS. 6A, 6B and 6C are useful in explaining the principle of control provided in the UHF band of the antenna of FIG. 1.

FIG. 8 illustrates directivity control in the UHF band of the antenna of FIG. 1.

FIG. 11 illustrates directivity control in the UHF band of the antenna of FIG. 9.

EMBODIMENTS

A multiple frequency band antenna according to a first embodiment of the present invention is arranged to receive radio waves in a first frequency band or UHF band, for example, ranging from 470 MHz to 890 MHz, and in a second frequency band or VHF band, for example, ranging from 54 MHz to 216 MHz. In addition, the multiple frequency band antenna has its directivity variable in the UHF and VHF bands, in a plurality of steps spaced by a predetermined amount, in sixteen (16) steps spaced by an angle of 22.5°, for example.

Figure 1:
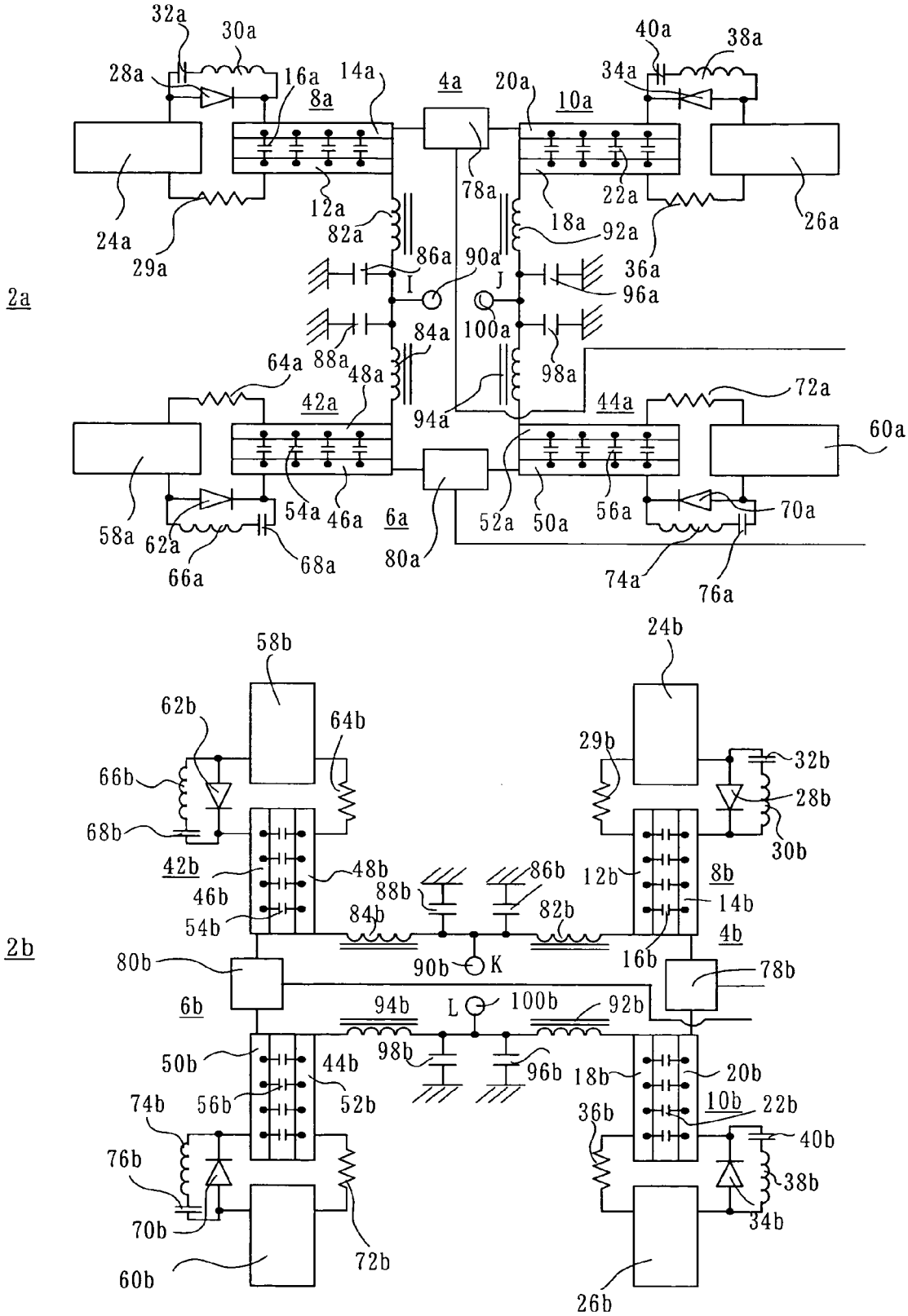
FIG. 1 shows part of a multiple frequency band antenna according to a first embodiment of the present invention.

As shown in FIG. 1, the multiple frequency band antenna according to the first embodiment has an antenna group including a first antenna 2*a* and a second antenna 2*b*.

The first antenna 2*a* may be formed on a printed circuit board (not shown), for example, and includes first and second dipole antennas 4*a* and 6*a*.

The first dipole antenna 4*a* includes dipole antenna elements 8*a* and 10*a*, which are arranged on a single straight line and have the same length. The length of the dipole antenna elements 8*a* and 10*a* is about a quarter (¼) of a given wavelength λ in the UHF band, for example. The dipole antenna element 8*a* includes two conductors 12*a* and 14*a* arranged in parallel with each other. A plurality of capacitors 16*a* are connected between the two conductors 12*a* and 14*a* at predetermined intervals along the length of the conductors. The capacitors 16*a* place the two conductors 12*a* and 14*a* at the same potential in terms of high frequency. Similarly, the dipole antenna element 10*a* includes two conductors 18*a* and 20*a* disposed in parallel with each other and connected to each other by a plurality of capacitors 22*a* at predetermined intervals along the conductors so that the conductors 18*a* and 20*a* are placed at the same potential in terms of high frequency. The entire length of the first dipole antenna 4*a*, which is substantially equal to the sum of the lengths of the dipole antenna elements 8*a* and 10*a*, is about a half (½) of the wavelength λ.

Outward of the outer end of the dipole antenna element 8*a*, an extension element 24*a* is disposed along the same straight line on which the dipole antenna elements 8*a* and 10*a* are disposed. Similarly, an extension element 26*a* is disposed outward of the outer end of the dipole antenna element 10*a* along the same straight line on which the dipole antenna elements 8*a* and 10*a* are disposed. The sum of the lengths of the dipole antenna element 8*a* and the extension element 24*a* is shorter than about a quarter (¼) of a given wavelength λ1 in the VHF band, and, similarly, the sum of the lengths of the dipole antenna element 10*a* and the extension element 26*a* is shorter than about a quarter (¼) of the given wavelength λ1.

A switch device, e.g. a PIN diode 28*a*, is connected between the conductor 14*a* of the dipole antenna element 8*a* and the extension element 24*a*. In the example shown in FIG. 1, the anode of the PIN diode 28*a* is connected to the extension element 24*a* and the cathode is connected to the conductor 14*a*. A DC path, e.g. a current limiting resistor 29*a*, is connected between the conductor 12*a* of the dipole antenna element 8*a* and the extension element 24*a*. Therefore, by applying a DC voltage between the conductors 12*a* and 14*a*, with the conductor 12*a* being positive and with the conductor 14*a* being negative, the PIN diode 28*a* is rendered conductive, so that the extension element 24*a* is electrically connected to the conductors 12*a* and 14*a*. Since the conductors 12*a* and 14*a* are connected together in terms of high frequency, the extension element 24*a* is connected to the parallel combination of the conductors 12*a* and 14*a* in terms of high frequency. Without the voltage stated above, the PIN diode 28*a* is nonconductive, and, therefore, the extension element 24*a* and the parallel combination of the conductors 12*a* and 14*a* are electrically disconnected from each other.

A series combination of an inductance element 30*a* and a DC blocking capacitor 32*a* is connected in parallel with the PIN diode 28*a*. The value of the inductance element 30*a* is determined such that at frequencies in the UHF band, the extension element 24*a* is substantially disconnected from the parallel conductors 12*a* and 14*a*, and at frequencies in the VHF band, the extension element 24*a* is substantially connected to the parallel conductors 12*a* and 14*a*, and that the sum electrical length of the dipole antenna element 8*a* and the extension element 24*a* can be equal to about a quarter (¼) of the given wavelength λ1 in the VHF band. The inductance element 30*a* acts as a switch device, too. Thus, at frequencies in the VHF band, the extension element 24*a* is substantially connected to the parallel conductors 12*a* and 14*a* even when the PIN diode 28*a* is nonconductive.

Similarly, a PIN diode 34*a*, a current limiting resistor 36*a*, an inductance element 38*a*, and a DC blocking capacitor 40*a* are connected between the conductors 18*a* and 20*a* of the dipole antenna element 10*a* and the extension element 26*a* in the same manner as described with respect to the dipole antenna element 8*a*. The length of the extension element 26*a* is determined in the same manner as the extension element 24*a*, and the value of the inductance element 38*a* is determined in the same manner as the inductance element 30*a*.

The second dipole antenna 6*a* is configured in the same manner as the first dipole antenna 4*a*, and includes dipole antenna elements 42*a* and 44*a*. The dipole antenna element 42*a* includes parallel conductors 46*a* and 48*a*, and the dipole antenna element 44*a* includes parallel conductors 50*a* and 52*a*. The conductors 46*a* and 48*a* are connected together by means of plural capacitors 54*a* in terms of high frequency, and the conductors 50*a* and 52*a* are connected together by means of plural capacitors 56*a* in terms of high frequency. Extension elements 58*a* and 60*a* are disposed outward of the outer ends of the dipole antenna elements 42*a* and 44*a*, respectively. A PIN diode 62*a*, a current limiting resistor 64*a*, an inductance element 66*a* and a DC blocking capacitor 68*a* are connected between the dipole antenna element 42*a* and the extension element 58*a*, as shown. Similarly, a PIN diode 70*a*, a current limiting resistor 72*a*, an inductance element 74*a* and a DC blocking capacitor 76*a* are connected between the dipole antenna element 44*a* and the extension element 60*a*, as shown. The lengths of the extension elements 58*a* and 60*a* are determined in the same manner as the extension elements 24*a* and 26*a*, and the values of the inductance elements 66*a* and 74*a* are determined in the same manner as the inductance elements 30*a* and 38*a*.

The second dipole antenna 6*a* is disposed in parallel with the first dipole antenna 4*a* and is spaced from the first dipole antenna 4*a* by a distance shorter than a quarter (¼) of the given wavelength λ in the UHF band.

Feed points are provided by the inner ends of the dipole antenna elements 8*a* and 10*a* of the first dipole antenna 4*a*, and the inner ends of the conductors 14*a* and 20*a* are connected to a matching device, e.g. a balun 78*a*. Similarly, feed points are provided by the inner ends of the dipole antenna elements 42*a* and 44*a* of the second dipole antenna 6*a*, and the inner ends of the conductors 46*a* and 50*a* are connected to a matching device, e.g. a balun 80*a*.

A series combination of high-frequency blocking coils 82*a* and 84*a* is connected between the conductors 12*a* and 48*a*, and capacitors 86*a* and 88*a* are connected between the junction of the coils 82*a* and 84*a* and a point of reference potential, as shown. A voltage supply terminal 90*a* is connected to the junction of the coils 82*a* and 84*a* for application of a positive voltage to render the PIN diodes 28*a* and 62*a* conductive. Also, a series combination of high-frequency blocking coils 92*a* and 94*a* is connected between the conductors 18*a* and 52*a*, and capacitors 96*a* and 98*a* are connected between the junction of the coils 92*a* and 94*a* and a point of reference potential, as shown. A voltage supply terminal 100*a* is connected to the junction of the coils 92*a* and 94*a* for application of a voltage to render the PIN diodes 34*a* and 70*a* conductive. The baluns 78*a* and 80*a* have points connected to a point of reference potential, and, therefore, the application of a positive voltage to the voltage supply terminal 96*a* or 100*a* causes a current to flow from the balun 78*a* or 80*a* to the reference potential point.

The second antenna 2*b* has substantially the same structure as the first antenna 2*a*, and is formed on a different printed circuit board than the first antenna 2*a*. Components of the second antenna 2*b* are provided with the same reference numerals as the equivalent components of the first antenna 2*a*, with the suffix letter "a" replaced by a suffix "b", and their detailed description is not made. The second antenna 2*b* is disposed substantially orthogonal to the first antenna 2*a*, with its center coinciding with the center of the first antenna 2*a*. The second antenna 2*b* does not contact the first antenna 2*a*.

Figure 2:
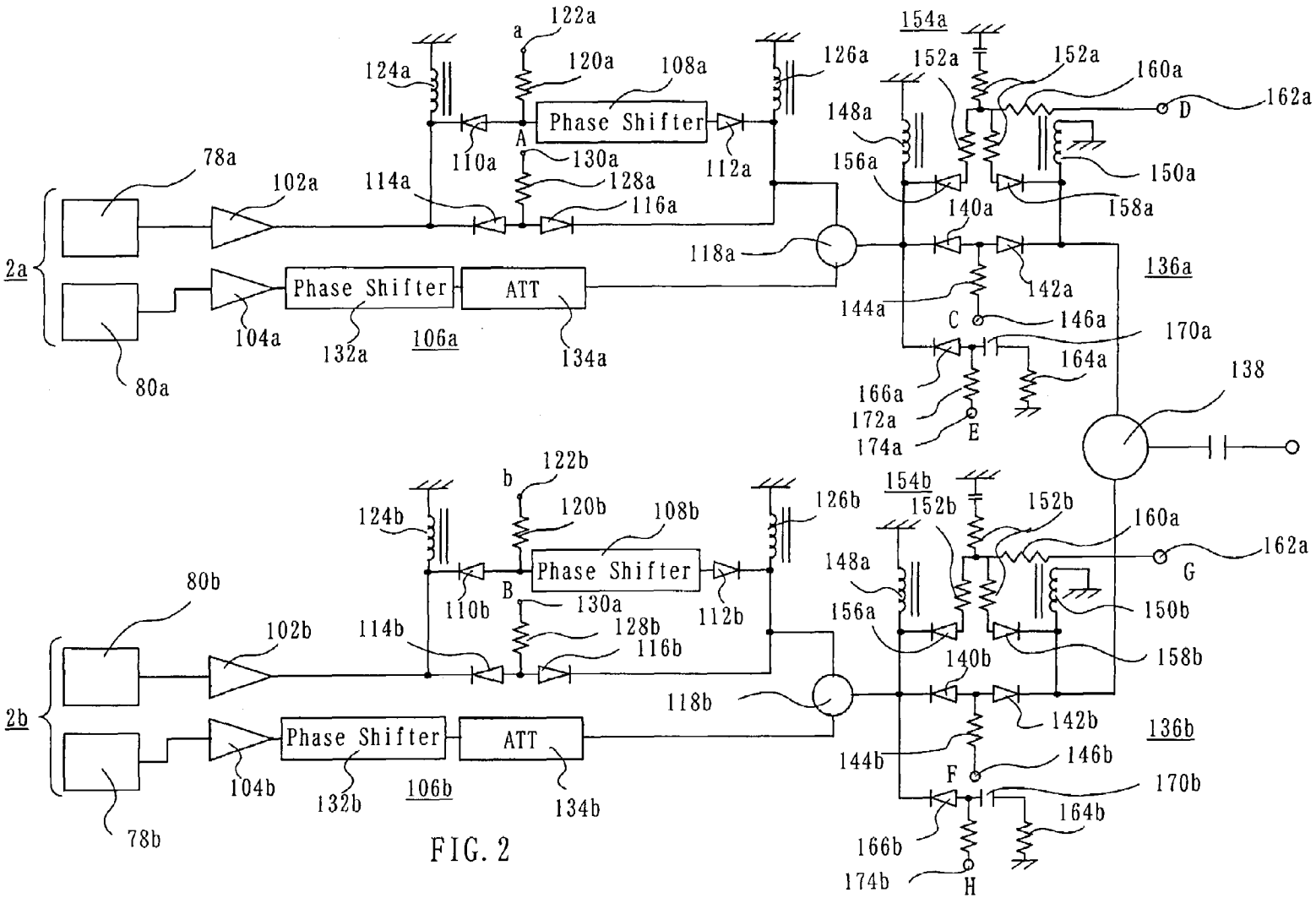
FIG. 2 shows the remaining portion of the antenna of FIG. 1.

As shown in FIG. 2, output signals of the baluns 78*a* and 80*a* of the first antenna 2*a* are amplified in amplifiers 102*a* and 104*a*, respectively, and applied to a variable phase shifter 106*a*.

Specifically, an output signal of the amplifier 102*a* is applied to a first phase shift circuit of the variable phase shifter 106*a*. The first phase shift circuit includes a series combination of a fixed phase shifter 108*a* and switch devices, e.g. PIN diodes 110*a* and 112*a*, which are connected to the respective ends of the fixed phase shifter 108*a*. Another series circuit of switch devices, e.g. PIN diodes 114*a* and 116*a*, is connected in parallel with the series combination of the phase shifter 108*a* and the PIN diodes 110*a* and 112*a*. The fixed phase shifter 108*a* is provided by a delay line, for example, or, more specifically, a coaxial cable or a microstrip line of a given length.

More specifically, the PIN diode 110*a* has its anode connected to the input of the fixed phase shifter 108*a* and has its cathode connected to the output of the amplifier 102*a*. The PIN diode 112*a* has its anode connected to the output of the fixed phase shifter 108*a* and has its cathode connected to a combiner 118*a*. The junction of the PIN diode 110*a* and the fixed phase shifter 108*a* is connected through a resistor 120*a* to a voltage supply terminal 122*a*. The cathodes of the PIN diodes 110*a* and 112*a* are connected to a point of reference potential through high-frequency blocking coils 124*a* and 126*a*, respectively. Accordingly, when a positive voltage is applied to the voltage supply terminal 122*a*, while the PIN diodes 114*a* and 116*a* are nonconductive, the PIN diodes 110*a* and 112*a* are rendered conductive, and the output of the amplifier 102*a* is delayed in the fixed phase shifter before being applied to the combiner 118*a*.

The anodes of the PIN diodes 114*a* and 116*a* are connected to each other. The cathode of the PIN diode 114*a* is connected to the cathode of the PIN diode 110*a*, and the cathode of the PIN diode 116*a* is connected to the cathode of the PIN diode 112*a*. The junction of the anodes of the PIN diodes 114*a* and 116*a* is connected to a voltage supply terminal 130*a* via a resistor 128*a*. Accordingly, when a positive DC voltage is applied to the voltage supply terminal 130*a*, the PIN diodes 114*a* and 116*a* are rendered conductive, and, therefore, the output of the amplifier 102*a* is coupled to the combiner 118*a* without being modified.

In the variable phase shifter 106*a*, the output signal of the amplifier 104*a* is applied to the combiner 118*a* via a fixed phase shifter 132*a* and an attenuator 134*a*. The fixed phase shifter 132*a* and the attenuator 134*a* form a second phase shift circuit. The fixed phase shifter 132*a* has the same configuration as the phase shifter 108*a*.

The amount of delay provided by the fixed phase shifter 108*a* to the output signal of the amplifier 102*a* is twice as much as the amount of delay provided by the fixed phase shifter 132*a* to the output signal of the amplifier 104*a*. The amount of delay provided by the fixed phase shifter 132*a* is so determined as to make the first antenna 2*a* exhibit a directivity in a particular direction, for example, in the backward direction in the UHF band.

Specifically, let it be assumed that the dipole antenna 4*a* is disposed to face forward, with the dipole antenna 6*a* facing backward. A radio wave coming toward the front of the first antenna 2*a* is received by the dipole antennas 4*a* and 6*a*, but the signal received by the dipole antenna 6*a* is delayed from the signal received by the dipole antenna 4*a* due to the spacing between the dipole antennas 4*a* and 6*a*. By further delaying the signal received at the dipole antenna 6*a* by such an amount as to provide a total amount of about λ/2, the signal received at the dipole antenna 6*a* can be made substantially 180° out of phase with the signal received at the dipole antenna 4*a*. When the signals as received at the dipole antennas 4*a* and 6*a*, which are 180° out of phase with each other are combined, the first antenna 2*a* does not exhibit directivity in the forward direction. A radio wave toward the back of the first antenna 2*a* from behind the first antenna 2*a* is also received by the dipole antennas 4*a* and 6*a*, but the signal received by the dipole antenna 4*a* is delayed from the signal as received by the dipole antenna 6*a* by the amount corresponding to the spacing between the two dipole antennas 4*a* and 6*a*. By delaying the signal received by the dipole antenna 6*a* by an appropriate amount, the phase difference between the signals received by the dipole antennas 4*a* and 6*a* can be reduced, so that the two received signals can be substantially in phase with each other, which means that the first antenna 2*a* exhibits directivity in the backward direction. The amount of delay provided by the fixed phase shifter 132*a* is determined to realize such control of the delay amounts.

From the above description, it is understood that in order to realize backward directivity of the first antenna 2*a*, the PIN diodes 114*a* and 116*a* are rendered conductive, and the PIN diodes 110*a* and 112*a* are rendered nonconductive.

Similarly, for realizing forward directivity of the first antenna 2*a*, the delaying by the fixed phase shifter 132*a* is reversed by 180°. For that purpose, the PIN diodes 110*a* and 112*a* are rendered conductive, and the PIN diodes 114*a* and 116*a* are rendered nonconductive. The output signal of the amplifier 102*a* is delayed in the fixed phase shifter 108*a* by an amount twice the amount of delay the fixed phase shifter 132*a* gives the output signal from the amplifier 104*a*. The signals resulting from the reception by the dipole antennas 4*a* and 6*a* of a radio wave coming toward the front side of the first antenna 2*a* from the front are substantially in phase with each other, while the signals resulting from the reception by the dipole antennas 4*a* and 6*a* of a radio wave coming from behind the first antenna 2*a* are substantially 180° out of phase with each other. The amplified and delayed versions of the signals from the baluns 78*a* and 80*a* are combined in the combiner 118*a*. This realizes forward directivity of the antenna 2*a*. As described, the directivity of the first antenna 2*a* can be switched between the forward and the backward by ON-OFF controlling the PIN diodes 110*a*, 112*a*, 114*a* and 116*a*.

Similarly, the signal received by the second antenna 2*b* is processed in a variable phase shifter 106*b* so that the second antenna 2*b* can exhibit selectively the rightward directivity and the leftward directivity. The configuration of the variable phase shifter 106*b* is the same as the variable phase shifter 106*a*. Therefore, components of the variable phase shifter 106*b* equivalent to the ones of the variable phase shifter 106*a* are provided with the same reference numerals as used for the components of the phase shifter 106*a*, with a suffix "b" substituted for "a", and no further description is given. It should be noted, however, that baluns 78*b* and 80*b* are connected respectively to amplifiers 104*b* and 102*b*.

The variable phase shifter 106*a* outputs a signal with forward or backward directivity, and the variable phase shifter 106*b* outputs a signal with rightward or leftward directivity. The directivities of the signals from the variable phase shifters 106*a* and 106*b* are selected as desired, and the signals are applied to level adjusting means, e.g. variable attenuators 136*a* and 136*b*, respectively, to thereby adjust their levels as desired, and combined the level adjusted signals with each other, so that the directivity of the antenna can be changed to any desired direction. Each of the variable attenuators 136*a* and 136*b* is configured to be able to provide one of three attenuation amounts, namely, 0 dB, 7 dB and infinite (∞). By the adjustment of the amounts of attenuation provided by the variable attenuators 136*a* and 136*b*, in combination with the adjustment of the directivities of the first and second antennas 2*a* and 2*b* through the adjustment of the variable phase shifters 106*a* and 106*b*, the directivity of the multiple frequency band antenna can be varied in, for example, sixteen (16) steps by a predetermined angular spacing of 22.5°.

For that purpose, the variable attenuator 136*a* includes switch devices, such as PIN diodes 140*a* and 142*a*, connected in series between the combiner 118*a* and another combiner 138. The PIN diode 140*a* has its cathode connected to the output of the combiner 118*a* and has its anode connected to the anode of the PIN diode 142*a*, which has its cathode connected to an input of the combiner 138. The mutually connected anodes of the PIN diodes 140*a* and 142*a* are connected through a resistor 144*a* to a voltage supply terminal 146*a*. The cathodes of the PIN diodes 140*a* and 142*a* are connected through respective high-frequency blocking coils 148*a* and 150*a* to a point of reference potential. When a positive voltage is applied to the voltage supply terminal 146*a*, the PIN diodes 140*a* and 142*a* are rendered conductive, so that the signal from the variable phase shifter 106*a* is coupled to the combiner 138 without being attenuated.

The variable attenuator 136*a* includes a fixed attenuator, e.g. a T-type attenuator 154*a*. The attenuator 154*a* includes three resistors 152*a* and provides an amount of attenuation of 7 dB. The input of the attenuator 154*a* is connected to a switch device. In the illustrated example, a PIN diode 156*a* is used as this switch device. The PIN diode 156*a* has its anode connected to the input of the attenuator 154*a* and has its cathode connected to the cathode of the PIN diode 140*a*. The output of the attenuator 154*a* is connected to a switch device. In the illustrated example, a PIN diode 158*a* is used as this switch device. The PIN diode 158*a* has its anode connected to the output of the attenuator 154*a*, and has its cathode of the PIN diode 158*a* connected to the cathode of the PIN diode 142*a*. The junction of the three resistors 152*a* of the T-type attenuator 154*a* is connected through a resistor 160*a* to a voltage supply terminal 162*a*. Accordingly, when a positive voltage is applied to the voltage supply terminal 162*a*, the PIN diodes 156*a* and 158*a* are rendered conductive, so that the T-type attenuator 154*a* is connected between the combiners 118*a* and 138. Thus, the signal from the variable phase shifter 106*a* is given an amount of attenuation of 7 dB.

The variable attenuator 136*a* includes further a matching resistor 164*a* having an impedance equal to the impedance of the first antenna 2*a*. The resistor 164*a* has its one end connected to a reference potential point, and has the other end connected through a DC blocking capacitor 170*a* to a switch device. In the illustrated example, a PIN diode 166*a* is used as this switch device. The other end of the resistor 164*a* is connected to the anode of the PIN diode 166*a* through the DC blocking capacitor 170*a*. The cathode of the PIN diode 166*a* is connected through a resistor 172*a* to a voltage supply terminal 174*a*. Accordingly, when a positive voltage is applied to the voltage supply terminal 174*a*, the PIN diode 166*a* is rendered conductive, so that the output of the combiner 118*a* is connected to a reference potential point through the matching resistor 164*a* and is subjected to attenuation of an infinite magnitude.

The variable attenuator 136*b* is configured similarly to the variable attenuator 136*a*. Components equivalent to the ones of the attenuator 136*a* are provided with the same reference numerals with the suffix "a" replaced by "b", and no further detailed description about the attenuator 136*b* is given.

Figure 3:
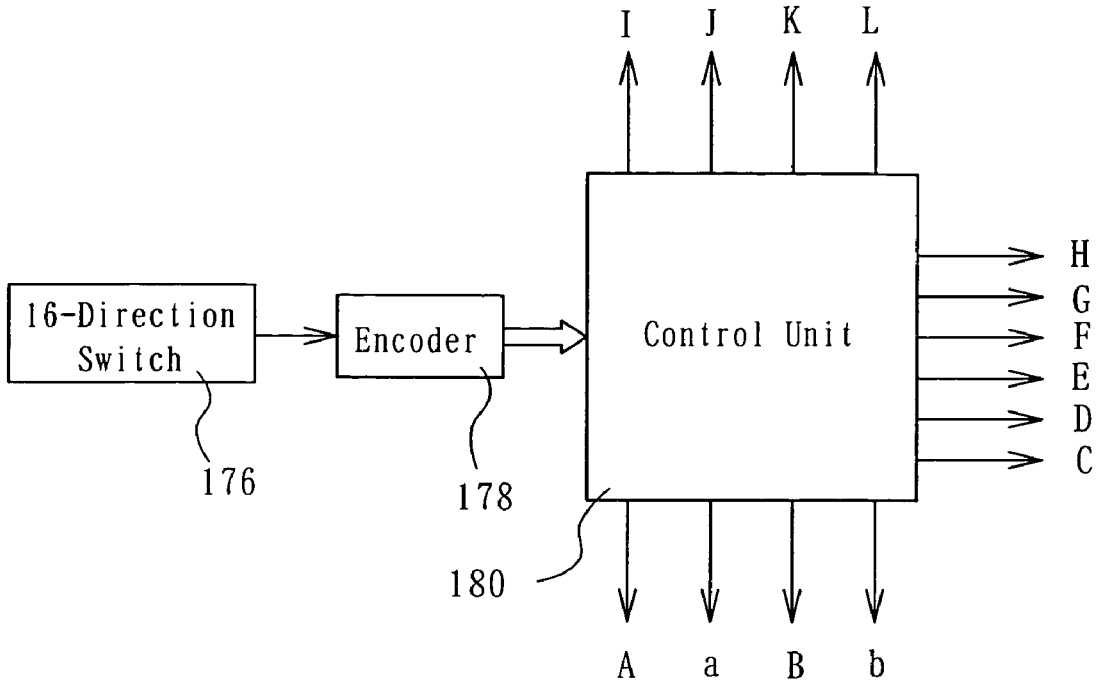
FIG. 3 shows a control unit of the antenna of FIG. 1.
Figure 7A:
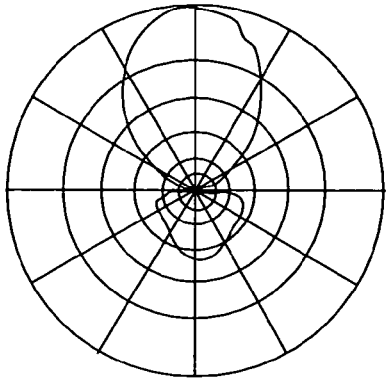
FIGS. 7A, 7B, 7C, 7D and 7E illustrate how the directivity pattern for the UHF band of the antenna of FIG. 1 can be changed.
Figure 7B:
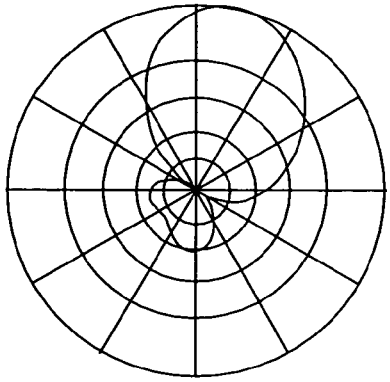
Figure 7C:
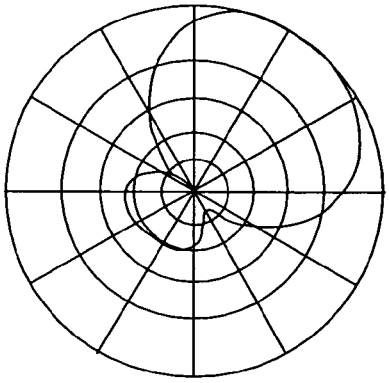
Figure 7D:
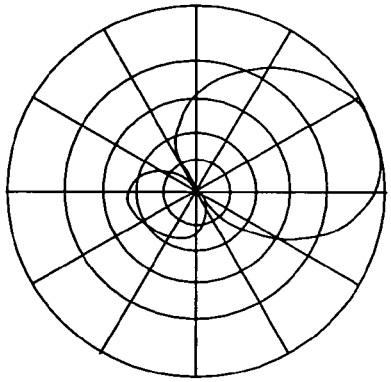
Figure 7E:
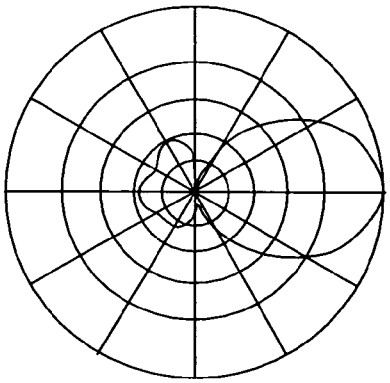

For varying the directivity as described above, the multiple frequency band antenna has a 16-direction switch 176, as shown in FIG. 3. The switch 176 is arranged to selectively provide output signals corresponding to sixteen (16) directions angularly spaced by 22.5° starting from 0°. In the direction of 0°, the directivity is exhibited in the straight forward direction of the antenna. The output signal of the 16-direction switch 176 is applied to an encoder 178, where it is converted into one of sixteen (16) 4-bit coded signals "0000", "0001", . . . , "1111", corresponding to the respective ones of the sixteen directions, as shown in FIG. 4. The coded signal is applied to a control unit 180. The control unit 180 responds to the inputted 4-bit coded signal and supplies appropriate voltages to the respective voltage supply terminals 122*a*, 130*a*, 122*b*, 130*b*, 146*a*, 162*a*, 174*a*, 146*b*, 162*b* and 174*b*. The output A of the control unit 180 is coupled to the voltage supply terminal 130*a* in FIG. 2, the output a is coupled to the terminal 122*a*, the output B is to the terminal 130*b*, the output b is to 122*b*, the output C is to the terminal

146*a*, the output D is to the terminal 162*a*, the output E is to the terminal 174*a*, the output F is to the terminal 146*b*, the output G is to the terminal 162*b*, and the output H of the control unit 180 is coupled to the voltage supply terminal 174*b*. In FIG. 4, the letters A, a, B, b, C, D, E, F, G and H correspond respectively to the outputs of the control unit 180. In FIG. 4, a numeral "1" denotes that a positive voltage is applied to the associated voltage supply terminals, and a numeral "0" denotes that no voltage is applied.

For the directivity of 0°, 22.5° and 45°, the variable attenuator 154*a* provides attenuation of 0 dB. For the directivity of 67.5° and 90°, the variable attenuator 154*a* provides an increasing amount of attenuation, namely, 7 dB and infinity. For the directivity of 112.5° and 135°, the attenuator 154*a* provide a decreasing amount of attenuation of 7 dB and zero (0). For the directivity of 157.5°, 180°, 202.5° and 225°, the amount of attenuation provided by the attenuator 154*a* remains zero (0). For the directivity of 247.5° and 270°, the attenuator 154*a* provides an increasing amount of attenuation, namely, 7 dB and infinity. For the directivity of 292.5° and 315°, the attenuator 154*a* provides a decreasing amount of attenuation, namely, 7 dB and zero (0). For the directivity of 337.5°, the amount of attenuation provided by the variable attenuator 154*a* is zero (0).

For the directivity of 0°, 22.5° and 45°, the variable attenuator 154*b* provides a decreasing amount of attenuation, namely, from infinity through 7 dB to zero (0). For the directivity of 67.5°, 90°, 112.5° and 135°, the variable attenuator 154*b* provides a constant amount of attenuation of zero (0). For the directivity of 157.5° and 180°, the variable attenuator 154*b* provides an increasing amount of attenuation, namely, 7 dB and infinity. For the directivity of 202.5° and 225°, the attenuator 154*b* provides a decreasing amount of attenuation, namely, 7 dB and zero (0). For the directivity of 247.5°, 270°, 292.5° and 315°, the attenuator 154*b* provides a constant amount of attenuation of zero (0). For the directivity of 337.5°, the amount of attenuation provided by the variable attenuator 154*b* is 7 dB. As described, when one of the variable attenuators 154*a* and 154*b* is providing an amount of attenuation of 0 dB, the amount of attenuation provided by the other increases or decreases.

Similar control is provided for either of UHF or VHF band reception. It should be noted that, when a radio wave in the VHF band is received, the extension elements 24*a*, 24*b*, 26*a*, 26*b*, 58*a*, 58*b*, 60*a* and 60*b* are connected to the associated dipole antenna elements 8*a*, 8*b*, 10*a*, 10*b*, 42*a*, 42*b*, 44*a* and 44*b*, respectively, by means of the inductance elements 30*a*, 30*b*, 38*a*, 38*b*, 66*a*, 66*b*, 74*a* and 74*b*, respectively.

As described above, the directivity of the multiple frequency band antenna according to the present invention can have its directivity varied both in the VHF band and the UHF band. In the UHF band, however, since the spacing between the dipole antennas 4*a* and 6*a* of the first antenna 2*a*, and the spacing between the dipole antennas 4*b* and 6*b* of the second antenna 2*b* are each less than $\lambda/4$, the directivity of the multiple frequency band antenna is more acute than when the spacing is $\lambda/4$. Therefore, when the signals are combined in the manner described above, the directivity pattern exhibits depressions at the angles other than 0°, 90°, 180° and 270°, as shown in FIG. 5.

In order to solve this problem, the extension elements 24*a*, 26*a*, 58*a* and 60*a* are used. For example, by rendering the PIN diodes 34*a* and 70*a* conductive to thereby connect the extension elements 26*a* and 60*a* to the dipole antenna elements 10*a* and 44*a*, respectively, when the first antenna 2*a* is set to exhibit the forward directivity represented by an arrow 200 in FIG. 6A through the adjustment of the variable phase shifter 106*a*, the dipole antenna elements 10*a* and 44*a* behave together as an asymmetrically loaded feed point dipole antenna described previously with respect to prior art, of which the directivity is tilted toward the 90° direction (i.e. the rightward direction along the horizontal axis in FIG. 6A) as represented by an arrow 202. On the other hand, when the extension elements 24*a* and 58*a* are connected respectively to the dipole antenna elements 8*a* and 42*a* by rendering the PIN diodes 28*a* and 62*a* conductive, the directivity of the resultant antenna tilts toward the 270° direction (i.e. the leftward direction along the horizontal axis in FIG. 6A) as represented by an arrow 204. Similarly, when the antenna exhibits the backward directivity as represented by a broken-line arrow 206 in FIG. 6A, by connecting the extension elements 26*a* and 60*a* to the dipole antenna elements 10*a* and 44*a*, respectively, by rendering the PIN diodes 34*a* and 70*a* conductive, the directivity of the resultant antenna tilts toward the 90° direction as indicated by a broken-line arrow 208. By rendering the PIN diodes 28*a* and 62*a* conductive to thereby connect the extension elements 24*a* and 58*a* to the dipole antenna elements 8*a* and 42*a*, respectively, the directivity of the resultant antenna tilts toward the 270° direction as indicated by a broken-line arrow 210.

Similarly, in the second antenna 2*b*, with its directivity oriented rightward as indicated by an arrow 212, as shown in FIG. 6B, through the adjustment of the variable phase shifter 106*b*, by rendering the PIN diodes 34*b* and 70*b* conductive to thereby connect the extension elements 26*b* and 60*b* to the dipole antenna elements 10*b* and 44*b*, respectively, the directivity of the antenna tilts toward the 180° direction (i.e. the downward direction along the vertical axis in FIG. 6B), as indicated by an arrow 214. When the PIN diodes 28*b* and 62*b* are rendered conductive to thereby connect the extension elements 24*b* and 58*b* to the dipole antenna elements 8*b* and 42*b*, respectively, the antenna directivity tilts toward the 0° direction (i.e. the upward direction along the vertical axis in FIG. 6B), as represented by an arrow 216. Similarly, with the leftward directivity as represented by a broken-line arrow 218, by rendering the PIN diodes 34*b* and 70*b* conductive to thereby connect the extension elements 26*b* and 60*b* to the dipole antenna elements 8*b* and 42*b*, respectively, the antenna directivity tilts toward the 180° direction as represented by a broken-line arrow 220. By rendering the PIN diodes 28*b* and 62*b* conductive to connect the extension elements 24*b* and 58*b* to the dipole antenna elements 8*b* and 42*b*, respectively, the antenna directivity tilts toward the 0° direction as indicated by a broken-line arrow 222.

Let it be assumed that the directivity is to be changed within a range of from 22.5° to 67.5°. First, as shown in FIG. 6C, the direction of directivity of the first antenna 2*a* is tilted rightward from its primary direction, and the direction of directivity of the second antenna 2*b* is tilted leftward from its primary direction. Then, the outputs of the first and second antennas 2*a* and 2*b* are combined in the manner described above, and the directions of the directivity of the first and second antennas 2*a* and 2*b* approach toward each other. As a result, as shown in FIGS. 7A through 7E, no remarkable depressions appear in the directivity patterns at any of the shown directions. The same result is obtained at the other directions.

To realize the above, the control unit 180 applies voltages to the voltage supply terminals 90*a*, 90*b*, 100*a* and 100*b*, too, in response to signals supplied to it from the encoder 178, as shown in FIG. 8. In FIG. 8, letters I, J, K and L represent the voltages to be applied to the voltage supply terminals 90*a*, 100*a*, 90*b* and 100*b*, respectively. A numeral "1" denotes that a positive voltage is applied, whereas a numeral "0" denotes that no voltage is applied. As is understood from FIG. 8, for the directivity in the directions at 22.5°, 45° and 67.5°, the directivity of the first antenna 2*a* is tilted toward the 90° direction (as represented by the arrow 202 in FIG. 6A), and the directivity of the second antenna 2*b* is tilted toward the 0° direction (as represented by the arrow 216 in FIG. 6B). For the directivity in the directions at 112.5°, 135° and 157.5°, the directivity of the first antenna 2*a* is tilted toward the 90° direction (as represented by the arrow 208 in FIG. 6A), and the directivity of the second antenna 2*b* is tilted toward the 180° direction (as represented by the arrow 214 in FIG. 6B). For the directivity in the directions at 202.5°, 225° and 247.5°, the directivity of the first antenna 2*a* is tilted toward the 270° direction (as represented by the arrow 210 in FIG. 6A), and the directivity of the second antenna 2*b* is tilted toward the 180°direction (as represented by the arrow 220 in FIG. 6B). For the directivity in the directions at 292.5°, 315°and 337.5°, the directivity of the first antenna 2*a* is tilted toward the 270° direction (as represented by the arrow 204 in FIG. 6A), and the directivity of the second antenna 2*b* is tilted toward the 0° direction (as represented by the arrow 222 in FIG. 6B).

With the above-described arrangement of the multiple frequency band antenna according to the present invention, the extension elements 24*a*, 24*b*, 26*a*, 26*b*, 58*a*, 58*b*, 60*a* and 60*b*, which are primarily used to receive radio waves in the VHF band, are taken advantage of in order to vary the directivity of the antenna in the UHF band. Accordingly, no additional components are required for varying the directivity in the UHF band. In addition, the control for varying the antenna directivity can be achieved by slightly modifying the control primarily provided by the control unit 180.

Figure 9:
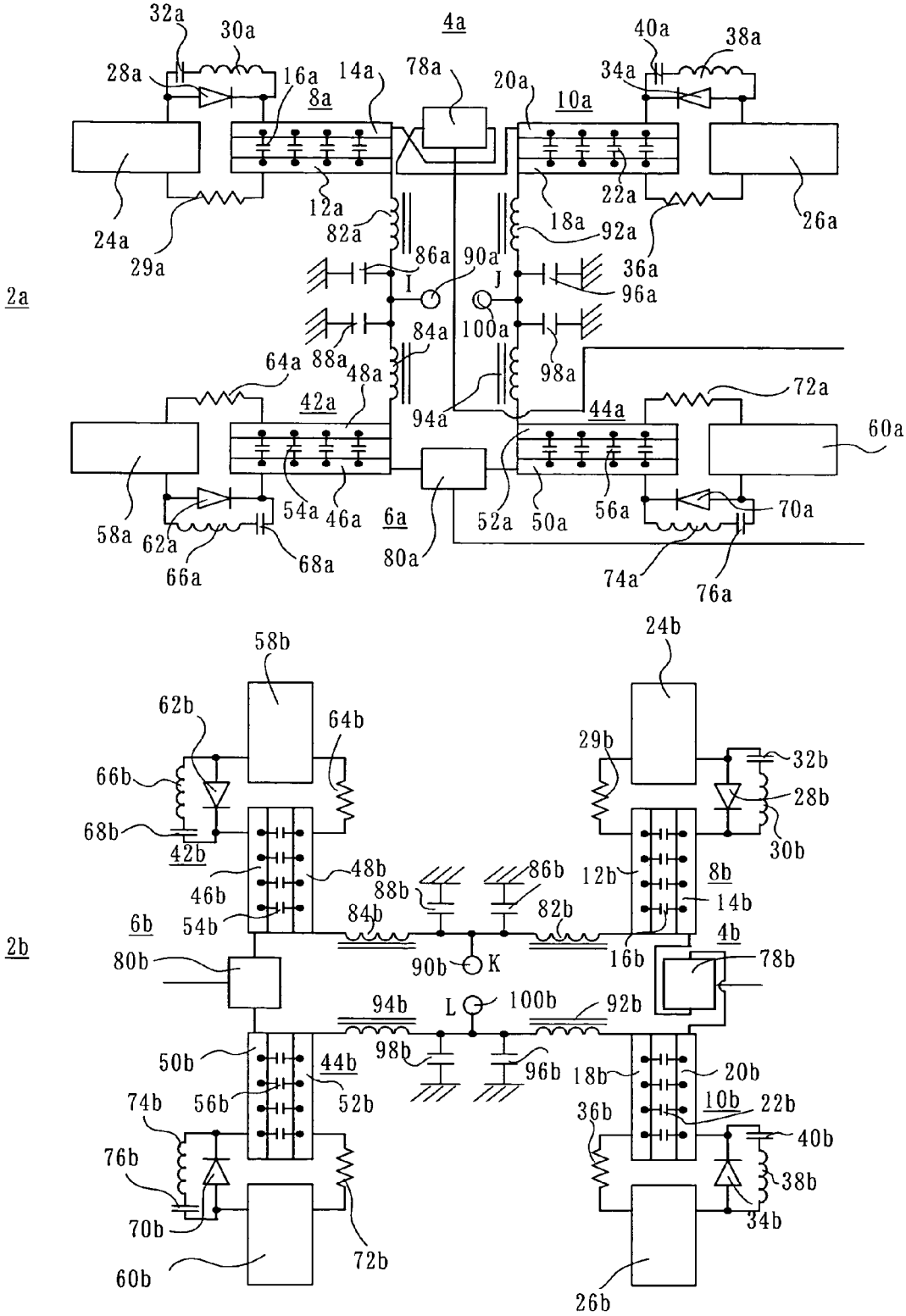
FIG. 9 shows part of a multiple frequency band antenna according to a second embodiment of the present invention.
Figure 10:
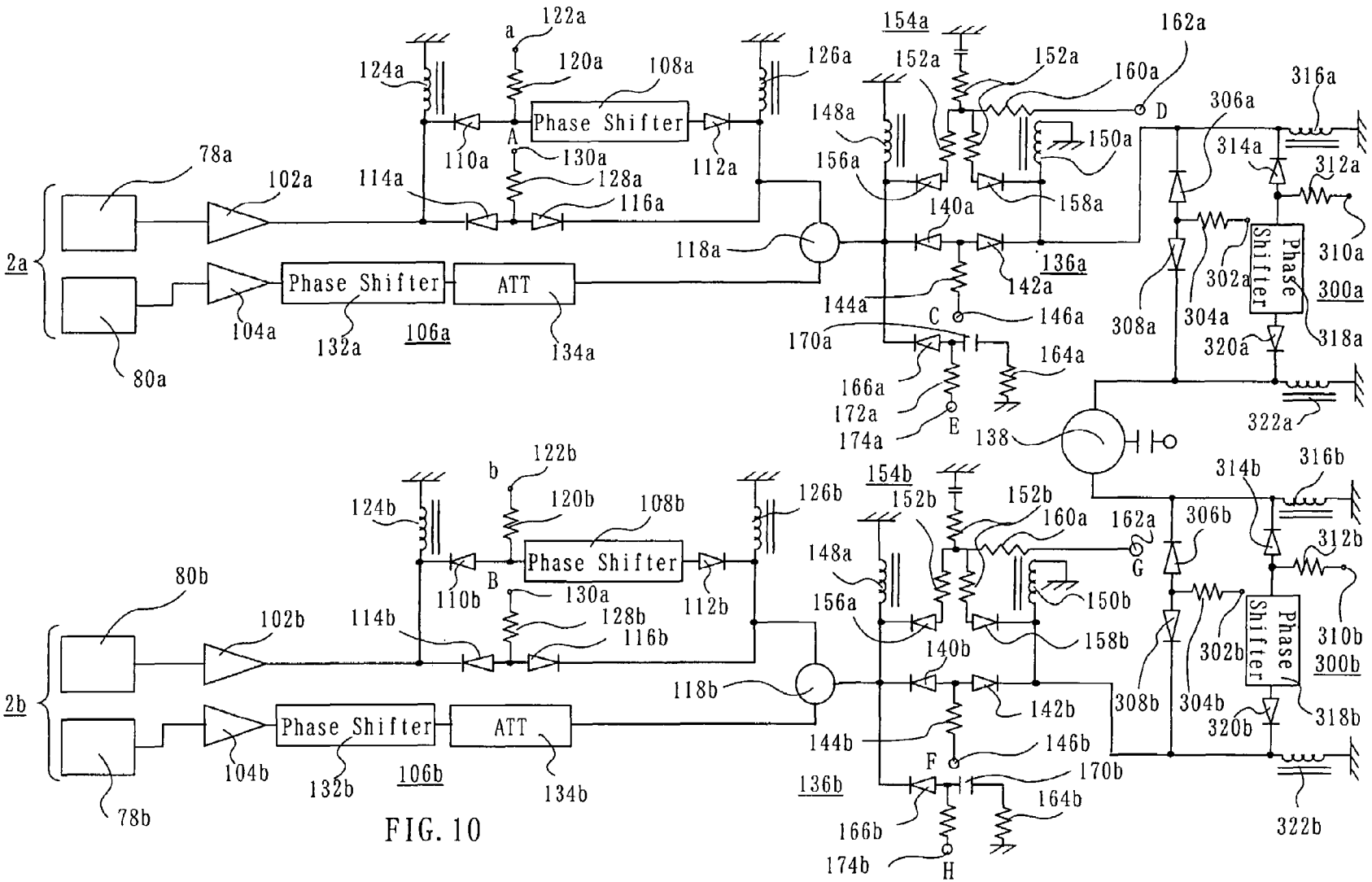
FIG. 10 shows the remaining portion of the antenna shown in FIG. 9.

FIGS. 9, 10 and 11 show a multiple frequency band antenna according to a second embodiment of the present invention. The overall configuration of the multiple frequency band antenna according to the second embodiment is substantially the same as that of the antenna according to the first embodiment, except the following. Accordingly, components and functions equivalent to those of the antenna of the first embodiment are given the same reference numerals and symbols as used for the first embodiment, and their detailed description is not given. The antenna according to the second embodiment differs from the one according to the first embodiment in the connections of the baluns 78*a* and 78*b*. In addition, variable phase shifters 300*a* and 300*b* (FIG. 10) are added.

As shown in FIG. 9, the connection of the balun 78*a* to the dipole antenna elements 8*a* and 10*a* is reversed relative to the connection of the balun 80*a* to the dipole antenna elements 42*a* and 44*a*. Similarly, the connection of the balun 78*b* to the dipole antenna elements 8*b* and 10*b* is reversed relative to the connection of the balun 80*b* to the dipole antenna elements 42*b* and 44*b*. Due to this connection, signals developed in the baluns 78*a* and 80*a* are 180° out of phase with each other, with the phase difference caused by the distance between the dipole antennas 4*a* and 6*a* ignored. Similarly, signals developed in the baluns 78*b* and 80*b* are 180° out of phase with each other, with the phase difference caused by the distance between the dipole antennas 4*b* and 6*b* ignored. With such connections of the baluns, the voltage (A) applied to the voltage supply terminal 130*a* and the voltage (a) applied to the voltage supply terminal 122*a* are reversed from the ones used in the antenna arrangement according to the first embodiment, as shown in FIG. 11. Also, the voltage (B) applied to the voltage supply terminal 130*b* and the voltage (b) applied to the voltage supply terminal 122*b* are reversed from the ones used in the antenna arrangement according to the first embodiment.

As shown in FIG. 10, in the multiple frequency band antenna according to the second embodiment, the variable phase shifter 300*a* is connected between the output of the variable attenuator 136*a* and the input of the combiner 138. Similarly, the variable phase shifter 300*b* is connected between the output of the variable attenuator 136*b* and the input of the combiner 138.

The variable phase shifters 300*a* and 300*b* have the same configuration as the first phase circuit of the variable phase shifter 106*a*. Accordingly, when a H-level voltage is applied to a voltage supply terminal 302*a*, a current flows through a resistor 304*a* and PIN diodes 306*a* and 308*a*, so that the output signal of the variable attenuator 136*a* is applied as it is to the combiner 138. On the other hand, if a H-level voltage is applied to a voltage supply terminal 310*a*, a current flows through a resistor 312*a*, a PIN diode 314*a* and a high-frequency blocking coil 316*a*, and also a current flows through the resistor 312*a*, a phase shifter 318*a*, a PIN diode 320*a* and a high-frequency blocking coil 322*a*, so that the phase of the output signal of the variable attenuator 136*a* is adjusted in the phase shifter 318*a* before it is applied to the combiner 138. When a H-level voltage is being applied to the voltage supply terminal 302*a*, the voltage supply terminal 310*a* is not supplied with a H-level voltage, and when a H-level voltage is being applied to the voltage supply terminal 310*a*, the voltage supply terminal 302*a* is not supplied with a H-level voltage.

The variable phase shifter 300*b* has the same configuration as the variable phase shifter 300*a*, and its components equivalent to those of the variable phase shifter 300*a* are given the same reference numerals with the suffix "b" and their detailed description is no given.

In realizing the directivity in a range between 0° and 90°, the antenna 2*a* uses the phase shifter 132*a* only, but the antenna 2*b* uses the phase shifters 132*b* and 108*b*. Accordingly, a phase difference is present between the output signal of the variable attenuator 136*a* corresponding to the signal received by the antenna 2*a* and the output signal of the variable attenuator 136*b* corresponding to the signal received by the antenna 2*b*, which are to be applied to the combiner 138. Such phase difference results in undesirable effects in the directivity pattern. Similar effects are seen when the directivity in a direction between 180° and 270° is to be obtained. When a directivity in the range of from 90° to 180° is to be achieved, both the antennas 2*a* and 2*b* utilize the phase shifters 132*a* and 108*a* and 132*b* and 108*b*, respectively, and, therefore, no phase difference is exhibited between the signals to be applied to the combiner 138 from the attenuator 136*a* corresponding to the signal received at the antenna 2*a*, and from the attenuator 136*b* corresponding to the signal received at the antenna 2*b*. When a directivity in the range of from 270° to 360° is to be achieved, both the antennas 2*a* and 2*b* utilize the phase shifters 132*a* and 132*b*, respectively, and, therefore, no phase difference is exhibited between the signals applied to the combiner 138.

The amounts of phase to be shifted by the phase shifters 300*a* and 300*b* are set to cancel the phase difference described above. For the directivity between 0° and 90°, a H-level voltage is applied to the voltage supply terminal 310*a* to cause the phase shifter 300*a* to adjust the phase of the signal from the variable attenuator 136*a* before applying it to the combiner 138, while a H-level voltage is applied to the voltage supply terminal 302*b* to cause the signal from the variable attenuator 136*b* corresponding to the signal received at the second antenna 2*b* to be applied as it is to the combiner 138. For the directivity in a range of from 90° to 180°, a H-level voltage is applied to each of the voltage supply terminals 302*a* and 302*b* so that the signals from the variable attenuators 136*a* and 136*b* can be applied to the combiner 138 without being modified. For the directivity in a range of from 180° to 270°, a H-level voltage is applied to the voltage supply terminal 310*b* to cause the phase shifter 300*b* to phase adjust the signal from the variable attenuator 136*b* before applying it to the combiner 138, whereas a H-level voltage is applied to the voltage supply terminal 302*a* so that the signal from the attenuator 136*a* can be applied as it is to the combiner 138. For the directivity in a range of from 270° to 360°, a H-level voltage is applied to each of the voltage supply terminals 302*a* and 302*b* so that the signals from the variable attenuators 136*a* and 136*b* can be applied to the combiner 138 without being modified. These H-level voltages are provided by the control unit 180, too.

Various modifications may be possible to the above-described embodiments. For example, the dipole antenna 4*a*, the extension elements 24*a* and 26*a*, the PIN diodes 28*a* and 34*a*, the resistors 29*a* and 36*a*, the reactance elements 30*a* and 38*a*, the DC blocking capacitors 32*a* and 40*a*, the high frequency blocking coils 82*a* and 92*a*, and the voltage supply terminals 90*a* and 100*a*, only, may be used to provide a 8-shaped directivity pattern antenna, in which either of the extension elements 24*a* and 28*a* is connected to the dipole antenna 4*a* to thereby vary the directivity in the UHF band, while making the antenna receivable of radio waves in the VHF band coming from a given direction, only. In another modification, only the first antenna 2*a* may be used. In still another modification, by arranging the circuitry to apply a DC voltage between the dipole antenna 4*a* and the extension elements, the dipole antenna elements 8*a* and 10*a* need not be formed of two conductors. In such case, each dipole antenna element 8*a* or 10*a* may be formed of one conductor.

In the multiple frequency band antenna according to either of the first and second embodiments, one extension element, e.g. the extension element 24*a*, is disposed outward of the outer end of each dipole antenna element, e.g. the dipole antenna element 8*a*. Instead, an additional extension element may be disposed outward of each extension element, with a switch device disposed between each extension element and the additional extension element, in order to receive radio waves in a third frequency band which is lower than the second frequency band. In still other modification, the directivity of the antenna can be tilted in two different ways, one by connecting one extension element, e.g. the extension element 24*a*, to the associated dipole antenna element, e.g. the dipole antenna element 8*a*, and the other by connecting the extension element 24*a* and the additional extension element to the dipole antenna element 8*a*.

The directivity of the multiple frequency band antenna according to the first and second embodiments is varied by operating the 16-direction switch 176. According to a third embodiment of the invention, the directivity is varied in response to a command given from a receiving apparatus with which the multiple frequency band antenna is used in a signal receiving system shown, for example, in FIG. 12.

Figure 13:
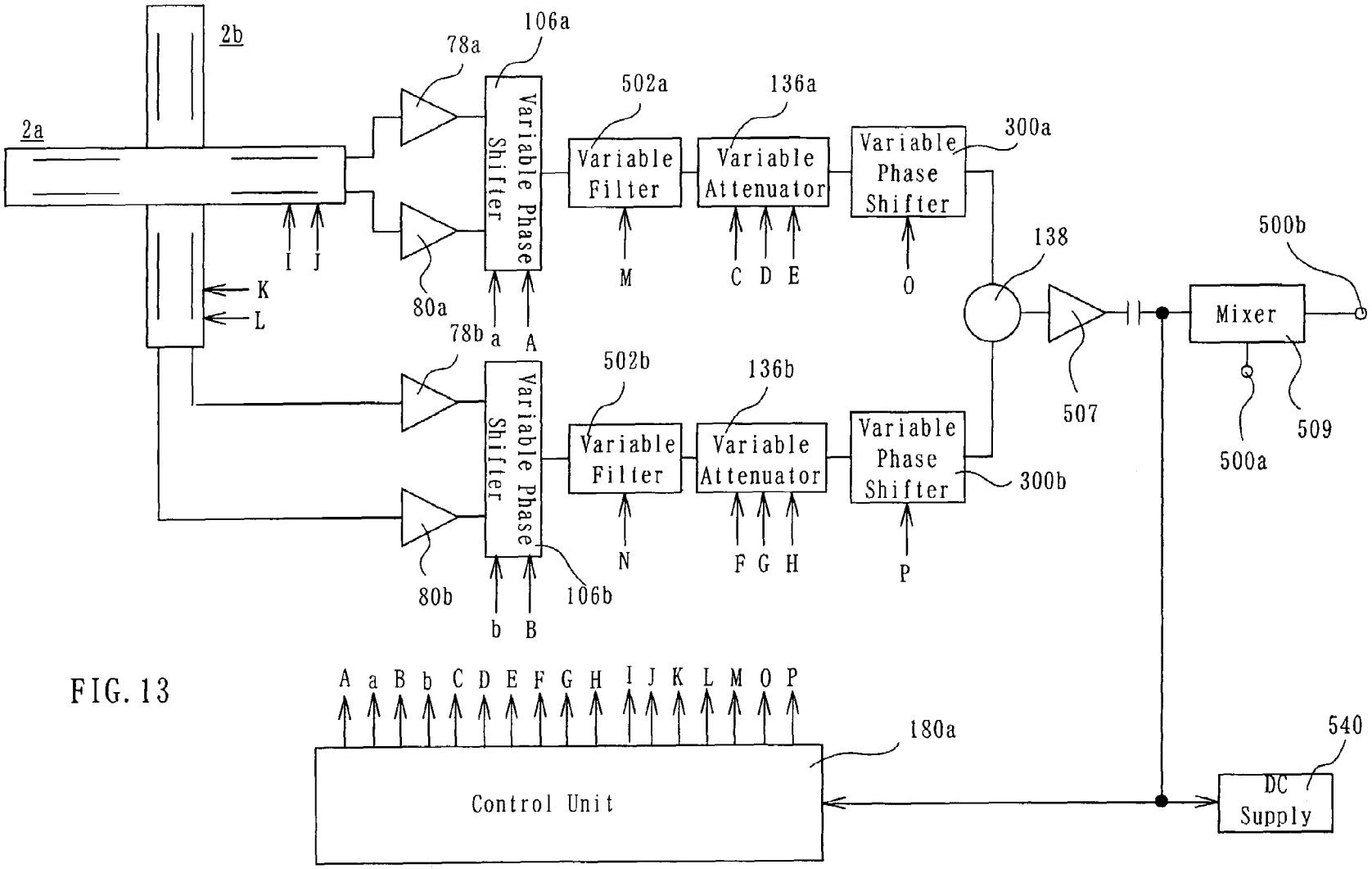
FIG. 13 is a block diagram of the modified multiple frequency band antenna used in the signal receiving system shown in FIG. 12.

As shown in FIG. 13, a variable directivity antenna system 500 has substantially the same configuration as the multiple frequency band antenna according to the second embodiment. Accordingly, components and functions equivalent to those of the antenna according to the second embodiment are given the same reference numerals and suffixes, and their detailed description is not given. It should be noted, however, that the antenna system 500 differs from the one according to the second embodiment in that variable filter means, e.g. variable filters 502*a* and 502*b*, are connected in the stage succeeding the variable phase shifters 106*a* and 106*b*, respectively. The variable filters 502*a* and 502*b* are bandpass filters with a variable passband. The passband of the filters 502*a* and 502*b* is varied in response to passband varying signals supplied thereto from passband varying control means, e.g. a control unit 180*a*. The passband of the filters 502*a* and 502*b* is varied in such a manner that the frequency of a radio wave to be received by the antenna system 500 can be within the passband. When, for example, radio waves in the UHF band are to be received, the passband of the filters 502*a* and 502*b* is changed so as to pass such waves, and if radio waves to be received are in the VHF band, the passband is changed to pass radio waves in the VHF band. Alternatively, high-pass or low-pass filters with variable cutoff frequency may be used in place of the bandpass filters 502*a* and 502*b*. In such a case, the cutoff frequencies of the filters are controlled such that the frequencies of radio waves to be received can be located within the passbands of the filters.

Figure 12:
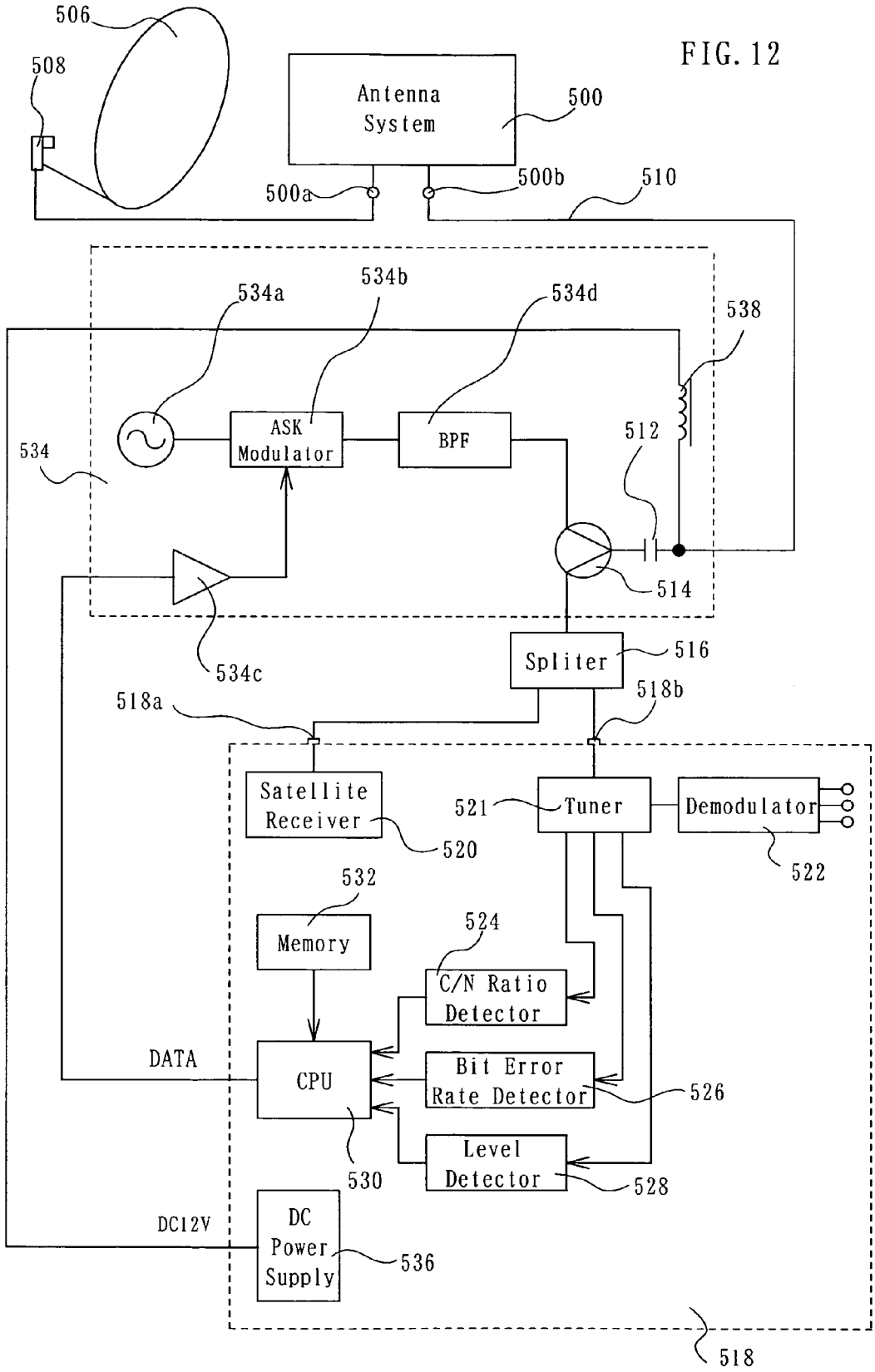
FIG. 12 is a block diagram of a signal receiving system which employs a modification of the multiple frequency band antenna shown in FIG. 9.

As shown in FIG. 12, an input terminal 500*a* of the antenna system 500 receives a satellite broadcast intermediate frequency (IF) signal. The satellite broadcast IF signal is produced by frequency converting a signal received at a satellite broadcast signal receiving antenna, e.g. a satellite broadcast signal receiving parabolic antenna 506, in a converter 508 associated with the parabolic antenna 506. The satellite broadcast IF signal is mixed in a mixer 509, with the output of the combiner 138 after it is amplified in an amplifier 507. The output of the combiner 138 is a UHF or VHF band television broadcast signal received by the antenna system 500. The mixture signal is outputted at an output terminal 500*b* of the antenna system 500. The mixture signal at the output terminal 500*b* is coupled through a transmission line 510, and through a DC blocking capacitor 512 and a mixer 514, which are included in an antenna control commander 534, to a splitter 516, where it is separated into the satellite broadcast IF signal and the VHF or UHF television broadcast signal. The satellite broadcast IF signal is then applied to a satellite broadcast IF signal input terminal 518*a* of a receiving apparatus 518, and the VHF or UHF television broadcast signal is applied to a UHF/VHF television broadcast signal input terminal 518*b* of the receiving apparatus 518.

The satellite broadcast IF signal at the satellite broadcast IF signal input terminal 518*a* is applied to a satellite receiver 520, where it is demodulated into a signal which is applied to a television receiver (not shown). The VHF or UHF television broadcast signal applied to the UHF/VHF television broadcast signal input terminal 518*b* is converted to an intermediate frequency (IF) signal in a tuner 521 and applied to a demodulator 522. Regardless whether it is an analog broadcast signal or a digital broadcast signal, the VHF or UHF television broadcast signal is demodulated in the demodulator 522, and the demodulated signal is coupled to the television receiver.

The IF signal from the tuner 521 is also applied to signal reception condition detecting units, e.g. a C/N ratio detector 524, a bit error rate detector 526 and a level detector 528. The C/N ratio detector 524 detects the C/N ratio of the VHF or UHF television broadcast signal, and develops a C/N ratio representative signal, which is applied to receiving apparatus control means, e.g. a CPU 530. The bit error detector 526 detects, when the VHF or UHF television broadcast signal is a digital broadcast signal, the bit error of the digital broadcast signal, and develops a bit error rate representative signal, which is applied to the CPU 530. The level detector 528 detects the level of the VHF or UHF television broadcast signal and develops a level representative signal, which is applied to the CPU 530.

The CPU 530 is provided with a memory 532. When an external command is given to the CPU 530 to receive a VHF or UHF channel, the CPU 530 reads antenna control data for that channel from the memory 532 and applies the readout data to the antenna control commander 534. The memory 532 contains antenna control data for conditioning the antenna system 500 to receive a desired radio wave (e.g. a television broadcast channel to be received). For that purpose, the antenna control data indicates whether the UHF band or VHF band is selected, in what direction the directivity is to be directed, what passband the variable filters have to have, and what phasing the variable phase shifters have to provide. The antenna control data is stored in the memory 532, being related to channel data indicating television broadcast channels to be received.

When the CPU 530 reads out of the memory 532, a channel data piece for receiving a television broadcast channel, the associated antenna control data is applied to the antenna control commander 534, which is provided as a separate unit from the receiving apparatus 518. The antenna control data is converted, in the antenna control commander 534, into a PSK (Phase-Shift-Keying) signal, an FSK (Frequency-Shift-Keying) signal, or an ASK (Amplitude-Shift-Keying) signal.

For conversion to an ASK signal, the antenna control commander 534 is provided with a carrier signal generator 534*a*, which generates a carrier signal at a frequency, e.g. 10.7 MHz, different from that of the signal received at and supplied from the antenna system 500. The carrier signal is supplied to an ASK modulator 534*b*, which receives also the antenna control data supplied from the memory 532 via a buffer 534*c*. The carrier signal is ASK modulated with the antenna control data, and the resulting ASK signal is outputted from the ASK modulator 534*b*. The ASK signal is caused to pass through a bandpass filter 534*d* which removes undesired signal components before outputting the filtered ASK signal. For conversion to PSK or FSK signal, a modulator for PSK or FSK modulating the carrier signal with the antenna control data is substituted for the modulator 534*b*.

The ASK signal is supplied through the transmission line 510 to the UHF/VHF television broadcast signal output terminal 500*b* (FIG. 13) of the antenna system 500, from which it is applied through the mixer 509 to the control unit 180*a*, where it is demodulated into the antenna control data, which is used to control the antenna system 500 in such a manner that it can exhibit a directivity to receive the desired television channel.

The tuner 521, then, develops an IF signal, and the C/N ratio detector 524, the bit error rate detector 526 and the level detector 528 operate to detect the C/N ratio, the bit error rate and the level of the IF signal, and the respective representative signals are applied to the CPU 530.

If the channel currently being received is a digital broadcast signal, and when any selected one of the C/N ratio, the bit error rate and the level of the received signal as outputted from the tuner 521, which selected one many be the C/N ratio, is below a predetermined reference value, or, in other words, when the signal receiving condition becomes unacceptable, the CPU 530 operates to vary the directivity of the antenna system 500 to the new one which provides the C/N ratio above the reference value, and substitute the antenna control data for the new directivity for the antenna control data used to receive that channel at the unacceptable C/N ratio. The new antenna control data is stored in the memory 532 and is used to receive that channel after that. When the bit error rate or the level is selected, a similar antenna control data renewal operation takes place.

If the channel being currently received is an analog broadcast channel, and when a selected one of the C/N ratio and the level of the received signal becomes below a predetermined reference value, the CPU 530 operates to adjust the directivity of the antenna system 500 and renew the antenna control data in a manner similar to the one described above with respect to the reception of a digital broadcast channel.

A DC voltage of, e.g. 12 V, is applied to the transmission line 510 from a DC power supply unit 536 in the signal receiving apparatus 518 through a high frequency blocking coil 538 in the antenna control commander 534, from which it is applied to the UHF/VHF television broadcast signal output terminal 500*b* of the antenna system 500. This DC voltage is then supplied through the mixer 509 to a voltage supply 540 for application to the control unit 180*a* and other units.

In the third embodiment, the antenna control commander 534 is described to be external to the signal receiving apparatus 518, but it may be provided in the signal receiving apparatus 518.

What is claimed is:

1. A multiple frequency band antenna comprising:

a dipole antenna arranged on a straight line; and at least two extension elements extending outward of respective ones of opposing outer ends of said dipole antenna along said straight line; wherein:

the length of said dipole antenna is determined to enable the multiple frequency band antenna to receive radio waves in a first frequency band, and the sum of the lengths of said dipole antenna and said two extension elements is determined to enable the multiple frequency band antenna to receive radio waves in a second frequency band lower than said first frequency band;

said multiple frequency band antenna further comprises:

first and second switch devices connected between respective ones of said two extension elements and associated ones of said outer ends of said dipole antennas; and control means operating, when a radio wave in said first frequency band is to be received, to selectively place said first and second switch devices in a first state in which said first and second switch devices are opened, a second state in which said first switch device is closed and said second switch device is opened, and a third state in which said first switch is opened and said second switch device is closed.

2. The multiple frequency band antenna according to claim 1 further comprising reactance elements connected in parallel with respective ones of said first and second switch devices, the values of said reactance elements being determined such as to substantially disconnect said dipole antenna and said extension elements in said first frequency band, and to substantially couple said dipole antenna and said extension elements in said second frequency band; said control means operating to open said first and second switch devices when said multiple frequency band antenna is to receive a radio wave in said second frequency band.

3. The multiple frequency band antenna according to claim 1 wherein said dipole antenna comprises two, straight dipole antenna elements each comprising two spaced apart, parallel conductors coupled together in terms of high frequency; and each of said first and second switch devices comprises a PIN diode connected between the outer end of one of said two conductors and the extension element disposed outward of said outer end, and a DC current path connected between the other of said two conductors and said extension element.

4. A multiple frequency band antenna comprising:

first and second dipole antennas disposed in parallel with each other, being spaced from each other by a distance equal to or smaller than a quarter of a wavelength in a first frequency band;

a group of extension elements including at least two first extension elements extending outward of respective ones of opposed outer ends of said first dipole antenna element along a first straight line, and at least two second extension elements extending outward of respective ones of opposed outer ends of said second dipole antenna element along a second straight line, the sum of the lengths of said first dipole antenna and said first extension elements and the sum of the lengths of said second dipole antenna and said second extension elements being so determined as to enable said multiple frequency band antenna to receive radio waves in a second frequency band lower than said first frequency band;

a group of switch devices including first and second switch devices connected between the respective ones of said first extension elements and the respective ones of said outer ends of said first dipole antenna, and third and fourth switch devices connected between the respective ones of said second extension elements and the respective ones of said outer ends of said second dipole antenna, said third and fourth switch devices being disposed at locations corresponding to the respective locations where said first and second switch devices are disposed;

control means operating, when said multiple frequency band antenna is to receive a radio wave in said first frequency band, to place said first, second, third and fourth switch devices selectively in a first state in which said first, second, third and fourth switch devices are opened, a second state in which said first and third switch devices are closed and said second and fourth switch devices are opened, and a third state in which said first and third switch devices are opened and said second and fourth switch devices are closed;

combining means connected to said first and second dipole antennas; and phase shift means connected between said first and second dipole antennas and said combining means, said phase shift means being switchable between:

a first signal coupling state in which signals resulting from a radio wave coming to said multiple frequency band antenna from a first direction substantially perpendicular to said first and second dipole antennas, as received by said first and second dipole antenna elements, are coupled to said combining means substantially in phase with each other, and signals resulting from a radio wave coming to said multiple frequency band antenna from a second direction opposite to said first direction, as received by said first and second dipole antenna elements, are coupled to said combining means substantially in 180° out of phase with each other, and a second signal coupling state in which signals resulting from a radio wave coming from said first direction as received by said first and second dipole antennas are coupled to said combining means substantially in 180° out of phase with each other, and signals resulting from a radio wave coming from said second direction as received by said first and second dipole antennas are coupled to said combining means substantially in phase with each other.

5. The multiple frequency band antenna according to claim 4 wherein said phase shift means includes a parallel combination of first fixed phase shift means and switching means, said parallel combination being connected between said first dipole antenna and said combining means, said phase shift means further comprising second fixed phase shift means connected between said second dipole antenna and said combining means, the amount of phase shift provided by said first fixed phase shift means being twice the amount of phase shift provided by said second fixed phase shift means.

6. A multiple frequency band antenna including an antenna group including orthogonally disposed first and second antennas, each of said first and second antennas comprising:

first and second dipole antennas disposed in parallel with each other, being spaced from each other by a distance equal to or smaller than a quarter of a wavelength in a first frequency band;

a group of extension elements including at least two first extension elements extending outward of respective ones of opposed outer ends of said first dipole antenna element along a straight line, and at least two second extension elements extending outward of respective ones of opposed outer ends of said second dipole antenna element along a straight line, the sum of the lengths of said first dipole antenna and said first extension elements and the sum of the lengths of said second dipole antenna and said second extension elements being so determined as to enable said multiple frequency band antenna to receive radio waves in a second frequency band lower than said first frequency band;

a group of switch devices including first and second switch devices connected between the respective ones of said first extension elements and the respective ones of said outer ends of said first dipole antenna, and third and fourth switch devices connected between the respective ones of said second extension elements and the respective ones of said outer ends of said second dipole antenna, said third and fourth switch devices being disposed at locations corresponding to the respective locations where said first and second switch devices are disposed;

first combining means connected to said first and second dipole antennas;

phase shift means connected between said first and second dipole antennas and said first combining means, said phase shift means being switchable between: and a first signal coupling state in which signals resulting from a radio wave coming to said multiple frequency band antenna from a first direction perpendicular to said first and second dipole antennas, as received by said first and second dipole antenna elements, are coupled to said first combining means substantially in phase with each other, and signals resulting from a radio wave coming to said multiple frequency band antenna from a second direction opposite to said first direction, as received by said first and second dipole antenna elements, are coupled to said first combining means substantially in 180° out of phase with each other, and a second signal coupling state in which signals resulting from a radio wave coming from said first direction as received by said first and second dipole antennas are coupled to said first combining means substantially in 180° out of phase with each other, and signals resulting from a radio wave coming from said second direction as received by said first and second dipole antennas are coupled to said first combining means substantially in phase with each other;

said multiple frequency band antenna further comprising:

first and second level adjusting means for adjusting the levels of the signals from said first and second antennas, respectively;

second combining means for combining output signals of said first and second level adjusting means; and control means for controlling said first, second, third and fourth switch devices of each of said first and second antennas, said phase shift means of each of said first and second antennas, and said first and second level adjusting means in such a manner that said multiple frequency band antenna can receive a radio wave in said first or second frequency band from a desired direction.

7. The multiple frequency band antenna according to claim 6 wherein variable phase shift means is connected between each of said first and second level adjusting means and said second combining means.

8. The multiple frequency band antenna according to claim 6 further comprising first and second amplifying means for amplifying the signals from said first and second dipole antennas, respectively, before coupling to said phase shift means.

9. A signal receiving system comprising the multiple frequency band antenna according to claim 6 wherein:

said control means is responsive to a control signal demodulated from a modulation signal supplied thereto from modulating means through a transmission line, by controlling said first through fourth switch devices of said first and second antennas, said variable phase shift means of said first and second antennas, and said first and second level adjusting means;

a signal from said second combining means is coupled through said transmission line to a signal receiving apparatus; and said modulating means modulates a carrier with a control signal supplied from said signal receiving apparatus to provide said modulation signal.

10. The signal receiving system according to claim 9 wherein said modulating means amplitude-shift-keying modulates said carrier.

11. The signal receiving system according to claim 9 wherein said signal receiving apparatus comprises:

signal receiving condition detecting means for detecting a signal receiving condition in which a desired radio wave is being received; and signal receiving apparatus control means for, when said signal receiving condition becomes unacceptable, varying said control signal to be supplied to said modulating means, and supplying said varied control signal to said modulating means when said signal receiving condition as detected by said signal receiving condition detecting means becomes acceptable.

12. The signal receiving system according to claim 9 wherein said antenna group is supplied with a signal as received by another antenna; combining means is associated with said antenna group to combine the signal from said another antenna with a signal from said antenna group; and an output signal of said combining means is supplied to said signal receiving apparatus through said transmission line.

* * * * *